US007778572B2

(12) United States Patent
Iijima

(10) Patent No.: US 7,778,572 B2
(45) Date of Patent: Aug. 17, 2010

(54) OPENING AND CLOSING ASSEMBLY, AND MULTIFUNCTION DEVICE INCLUDING THE ASSEMBLY

(75) Inventor: Shota Iijima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 678 days.

(21) Appl. No.: 11/765,325

(22) Filed: Jun. 19, 2007

(65) Prior Publication Data

US 2007/0292159 A1 Dec. 20, 2007

(30) Foreign Application Priority Data

Jun. 19, 2006 (JP) ..... 2006-168841

(51) Int. Cl.
*G03G 15/00* (2006.01)
*G03G 21/16* (2006.01)
*B41J 29/13* (2006.01)

(52) U.S. Cl. ..... 399/125; 347/108

(58) Field of Classification Search ..... 399/107, 399/125, 367, 377, 379; 347/108; 220/254.1, 220/254.7, 780, 831–835; 312/319.2, 326–329, 312/350

See application file for complete search history.

(56) References Cited

U.S. PATENT DOCUMENTS 7,369,794 B2 * 5/2008 Kawai et al. ..... 399/125

FOREIGN PATENT DOCUMENTS

JP 1-29815 Y2 7/1989
JP 3093658 U 2/2003

* cited by examiner

*Primary Examiner*—David M Gray
*Assistant Examiner*—Gregory H Curran
(74) *Attorney, Agent, or Firm*—Baker Botts L.L.P.

(57) ABSTRACT

An opening and closing assembly includes: (a) a first casing body; (b) a second casing body pivotable to be selectively placed in open and closed positions relative to the first casing body; and (c) a support stand for supporting the second casing body to maintain the open position. The support stand includes (c-1) a proximal end portion pivotably connected to one of the first and second casing bodies and (c-2) a distal end portion slidably connected to the other of the first and second casing bodies. The other of the first and second casing bodies includes (i) a guide portion for guiding the distal end portion of the support stand, and (ii) first and second wall portions cooperating with each other for gripping the distal end portion of the support stand. The distal end portion of the support stand includes a gripped portion having a thickness that is increased in a direction away from the distal end portion of the support stand toward the proximal end portion of the support stand.

11 Claims, 18 Drawing Sheets

OPENING AND CLOSING ASSEMBLY, AND MULTIFUNCTION DEVICE INCLUDING THE ASSEMBLY

This application is based on Japanese Patent Application No. 2006-168841 filed on Jun. 19, 2006, the content of which is incorporated hereinto by reference.

BACKGROUND OF THE INVENTION

1. Field of the Invention

The present invention relates to an opening and closing assembly including an opening and closing mechanism and first and second casing bodies pivotable relative to each other, wherein the opening and closing mechanism is capable of maintaining an open position of the second casing body relative to the first casing body and opening and closing the second casing body relative to the first casing body in suitable manners.

2. Discussion of Related Art

Conventionally, there have been proposed various kinds of structures each of which is to be incorporated in an opening and closing assembly including first and second casing bodies pivotable relative to each other through a hinge and each of which is arranged to maintain an open position of the second casing body relative to the first casing body when the second casing body should be held in the open position. As an example of the opening and closing assembly incorporating such a structure, there is a so-called "multifunction device", i.e., a device having multifunctions such as printer, scanner, copier and facsimile functions.

For performing the multifunctions, the multifunction device has an image recording unit operable to record an image on a recording medium and also an image reading unit operable to read an image carried on an original.

The image reading unit is provided by a flat bed scanner, for example. In some case, the flat bed scanner is provided with an automatic document feeder (ADF) that is arranged to automatically feed an original document. The flat bed scanner has a document setting table having an upper surface that is provided by a platen glass, and also a document cover for covering the upper surface of the document setting table and fixing the original document onto the platen glass. When an image carried on the original document is to be read by the image reading unit, the original document is set on the platen glass after the document cover is opened relative to the document setting table. The original document is fixed onto the platen glass, with the document cover is closed relative to the document setting table. The original document is scanned by an image sensor that is reciprocatably disposed inside the document setting table, i.e., below the platen glass, whereby the image carried on the original document is read based on an electric signal representative of the image.

In the multifunction device, it is common that the image reading unit is disposed on an upper side of the image recording unit, for facilitating setting of the original document onto the platen glass of the flat bed scanner.

On the other hand, the image recording unit of the multifunction device requires a maintenance work such as replacement of ink cartridges and removal of recording mediums jammed inside the image recording unit. For allowing an operator to access inside the image recording unit for carrying out the maintenance work, at least a part of a casing body of the image recording unit has to be exposed as needed.

The above-described opening and closing mechanism is employed to open and close the image reading unit relative to the image recording unit. It is preferable that the image reading unit is held open relative to the image recording unit during the maintenance work. To this purpose, as disclosed in JP-U-3093658 (Japanese Utility Model registered in 2003), the opening and closing mechanism has a stopper member that is disposed in a diagonal attitude for maintaining the open position of the image reading unit relative to the image recording unit According to the disclosure of JP-U-3093658, the image reading unit (scanner casing body) is attached to the image recording unit (printer casing body), pivotably about a pivot axis that is provided in its end portion. Between the image reading unit and the image recording unit, the stopper member (scanner support stand) is provided to maintain a state in which the image reading unit is opened relative to the image recording unit by a predetermined angle. On a lower surface of the image reading unit, there is provided a pivot shaft receiver by which one of opposite end portions of the stopper member is pivotably received. On an upper surface of the image recording unit, there is provided an accommodating portion (scanner-support-stand accommodating hole) that is arranged to accommodate therein the stopper member such that the other of the opposite end portions of the stopper member is first introduced into the accommodating portion and then the above-described one of the opposite end portions of the stopper member is introduced into the accommodating portion. The above-described other of the opposite end portions of the stopper member includes an engaging portion that can be held in engagement with an opening of the accommodating portion and an elastic body that is elastically pressed against a periphery of the opening of the accommodating portion. With the engagement of the engaging portion of the stopper member with the opening of the accommodating portion, the image reading unit is held in its open position relative to the image recording unit. With disengagement of the engaging portion of the stopper member from the opening of the accommodating portion, the stopper member is accommodated in the accommodating portion whereby the image reading unit is placed in its closed position relative to the image recording unit. In an initial stage of a closing transition from the open position to the closed position and also a final stage of an opening transition from the closed position to the open position, the above-described elastic body is elastically pressed against the periphery of the opening of the accommodating portion whereby a load is applied against pivot motion of the image reading unit relative to the image recording unit. That is, in the initial stage of the closing transition and the final stage of the opening transition, the image reading unit is slowly pivoted. It is therefore possible to prevent a hand of an operator from being caught between the image reading unit and the image recording unit during a maintenance work, since the image reading unit is not rapidly pivoted from the above-described predetermined angle toward the closed position.

However, in the above-described arrangement disclosed in JP-U-3093658, the load can not be applied against the pivot motion in a final stage of the closing transition, i.e., in a stage until the image reading unit is completely closed relative to the image recording unit after the above-described initial stage of the closing transition. That is, in the final stage of the closing transition, the image reading unit could be rapidly pivoted toward the closed position due to its own weight, causing collision of the image reading unit with the image recording unit, and accordingly causing a risk of damages of the image reading and recording units.

JP-H01-29815Y2 (Japanese Examined Utility Model Application published in 1989) discloses an opening and closing mechanism arranged to open and close a cover body attached to a casing body that provides, for example, a data terminal unit. According to the disclosure of JP-H01-29815Y2, the cover body is pivotable relative to the casing body to which the cover body is connected via a guide member. The guide member is provided by an arcuate-shaped member that is arranged to extend from a side surface of the cover body toward the casing body. The guide member has a guide slot formed therethrough to be aligned with a position of a screw receiver hole that is provided in the casing body. A screw bolt is provided to pass through the guide slot and the screw receiver hole and to be screwed into a nut, so that the guide member and the casing body are gripped between a head of the screw bolt and the nut, for thereby maintaining a predetermined angular position in which the cover body is opened relative to the casing body by a predetermined angle. Further, in JP-H01-29815Y2, a torsion spring is provided in the casing body, so as to bias the cover body in a direction away from the casing body. In a final stage of the closing transition from the open position toward the closed position, the cover body is biased by the torsion spring in the direction away from the casing body. Therefore, in the arrangement disclosed in JP-H01-29815Y2, it is possible to prevent the cover body from being rapidly pivoted toward the closed position and accordingly to avoid the image reading and recording units from being damaged.

SUMMARY OF THE INVENTION

In the multifunction device, it is preferable that the image reading unit can be smoothly and quickly opened relative to the image recording unit, for facilitating the above-described maintenance work.

In the arrangement of JP-H01-29815Y2, the cover body is biased upwardly, i.e., in the direction away from the casing body only in the final stage of the closing transition and the initial stage of the opening transition, and the cover body is stopped in the predetermined angular position relative to the casing body. Therefore, a large force is required to cause the cover body to be pivoted relative to the casing body.

The present invention was made in view of the background prior art discussed above. It is therefore a first object of the invention to provide an opening and closing assembly in which a load applied against a pivot motion of a second casing body relative to a first casing body is increased in a closing transition from an open position of the second casing body to a closed position of the second casing body and is reduced in an opening transition from the closed position to the open position, namely, in which the second casing body can be smoothly and quickly opened relative to the first casing body while the second casing body is prevented from being rapidly closed relative to the first casing body. It is a second object of the invention to provide a multifunction device including the opening and closing assembly which has the above-described technical advantage. The first and second objects may be achieved according to first and second aspects of the invention, respectively, which are described below.

The first aspect of the invention provides an opening and closing assembly including: (a) a first casing body having a connected portion and a distant portion that is distant from the connected portion; (b) a second casing body having a connected portion and a distant portion that is distant from the connected portion of the second casing body, the second casing body being connected at the connected portion thereof to the connected portion of the first casing body, and being pivotable about the connected portions of the respective first and second casing bodies relative to the first casing body so as to be selectively placed in open and closed positions relative to the first casing body; and (c) a support stand configured to support the second casing body so as to maintain the open position of the second casing body when the second casing body is to be held in the open position, the support stand including (c-1) a proximal end portion that is pivotably connected to the distant portion of one of the first and second casing bodies and (c-2) a distal end portion that is slidably connected to the other of the first and second casing bodies, wherein the other of the first and second casing bodies includes (i) a guide portion configured to guide the distal end portion of the support stand, for permitting the distal end portion of the support stand to be slidable between the connected portion and the distant portion of the other of the first and second casing bodies, and (ii) first and second wall portions opposed to each other and cooperating with each other for gripping the distal end portion of the support stand that is interposed between the first and second wall portions, wherein the distal end portion of the support stand includes a gripped portion at which the distal end portion can be gripped between the first and second wall portions of the other of the first and second casing bodies, and at which the distal end portion can be brought into slidable contact with the first and second wall portions of the other of the first and second casing bodies, and wherein a thickness of the gripped portion, as measured in an opposed direction in which the first and second wall portions are opposed to each other, is increased in a direction away from the distal end portion of the support stand toward the proximal end portion of the support stand.

The opening and closing assembly constructed according to the present invention is advantageous, for example, where the gripped portion of the distal end portion of the support stand is wedged into between the first and second wall portions by a larger extent during a closing transition from the open position of the second casing body to the closed position of the second casing body during which the distant portion of the second casing body is forced in a direction toward the distant portion of the first casing body, than during an opening transition from the closed position to the open position during which the distant portion of the second casing body is forced in a direction away from the distant portion of the first casing body. That is, when the second casing body is being closed relative to the first casing body, a relatively large frictional force is generated between the gripped portion of the distal end portion of the support stand and each of the first and second wall portions of the above-described other of the first and second casing bodies, whereby the second casing body is prevented, owing to the large frictional force, from being rapidly pivoted relative to the first casing body in its closing direction. It is therefore possible to prevent a hand of an operator from being caught between the first and second casing bodies when the operator intends to place the second casing body into its closed position relative to the first casing body. On the other hand, when the second casing body is being opened relative to the first casing body, a relatively small frictional force is generated between the gripped portion of the distal end portion of the support stand and each of the first and second wall portions of the above-described other of the first and second casing bodies, whereby the second casing body can be easily pivoted relative to the first casing body in its opening direction.

According to an advantageous arrangement of the first aspect of the invention, the support stand is provided by at least two portions including a high friction portion which has a higher coefficient of friction than the other of the at least two portions, wherein the gripped portion of the distal end portion of the support stand has a contact surface which can be brought into slidable contact with the first and second wall portions of the other of the first and second casing bodies and which is at least partially provided by the high friction portion.

In this advantageous arrangement, when the second casing body is being closed relative to the first casing body, the frictional force generated between the gripped portion of the distal end portion of the support stand and each of the first and second wall portions of the above-described other of the first and second casing bodies can be made larger than in an arrangement in which the contact surface of the gripped portion is not provided by the high friction portion. Therefore, the second casing body can be more reliably prevented from being rapidly pivoted relative to the first casing body in its closing direction, thereby making it possible to more reliably prevent a hand of an operator from being caught between the first and second casing bodies when the operator intends to place the second casing body into its closed position relative to the first casing body.

According to another advantageous arrangement of the first aspect of the invention, the other of the first and second casing bodies is brought into contact at one of opposite side surfaces thereof with the one of the first and second casing bodies when the second casing body is placed in the closed position, wherein the other of the first and second casing bodies includes a portion in which a distance between the first and second wall portions of the other of the first and second casing bodies, as measured in the opposed direction, is reduced in a direction away from the one of the opposite side surfaces toward the other of the opposite side surfaces.

In this another advantageous arrangement, when the gripped portion of the distal end portion of the support stand is gripped between the first and second wall portions of the above-described other of the first and second casing bodies, a contact area of the gripped portion, which is held in contact with the first and second wall portions, can be made larger than in an arrangement in which the distance between the first and second wall portions is constant. The increase in the contact area of the gripped portion leads to an increase in the frictional force generated between the gripped portion of the distal end portion of the support stand and each of the first and second wall portions of the above-described other of the first and second casing bodies when the second casing body is being closed relative to the first casing body. Therefore, the second casing body can be more reliably prevented from being rapidly pivoted relative to the first casing body in its closing direction, thereby making it possible to more reliably prevent a hand of an operator from being caught between the first and second casing bodies when the operator intends to place the second casing body into its closed position relative to the first casing body.

The second aspect of the invention provides a multifunction device including the opening and closing assembly defined in the first aspect of the invention, wherein the first casing body of the opening and closing assembly provides an image recording unit configured to record an image on a recording medium, while the second casing body of the opening and closing assembly provides an image reading unit configured to read an image carried on an original.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIGS. 15A and 15B are cross sectional view each showing the inside of the accommodating recess in an intermediate region of the guide groove formed in the load adjuster member, wherein FIG. 15A shows the inside of the accommodating recess when the load adjuster member is placed in its fully gripping position, and wherein FIG. 15B shows the inside of the accommodating recess when the load adjuster member is placed in its non-fully gripping position;

FIGS. 16A and 16B are cross sectional view each showing the inside of the accommodating recess in a closing side region of the guide groove formed in the load adjuster member, wherein FIG. 16A shows the inside of the accommodating recess when the load adjuster member is placed in its fully gripping position, and wherein FIG. 16B shows the inside of the accommodating recess when the load adjuster member is placed in its non-fully gripping position;

DETAILED DESCRIPTION OF THE PREFERRED EMBODIMENT

Figure 1:
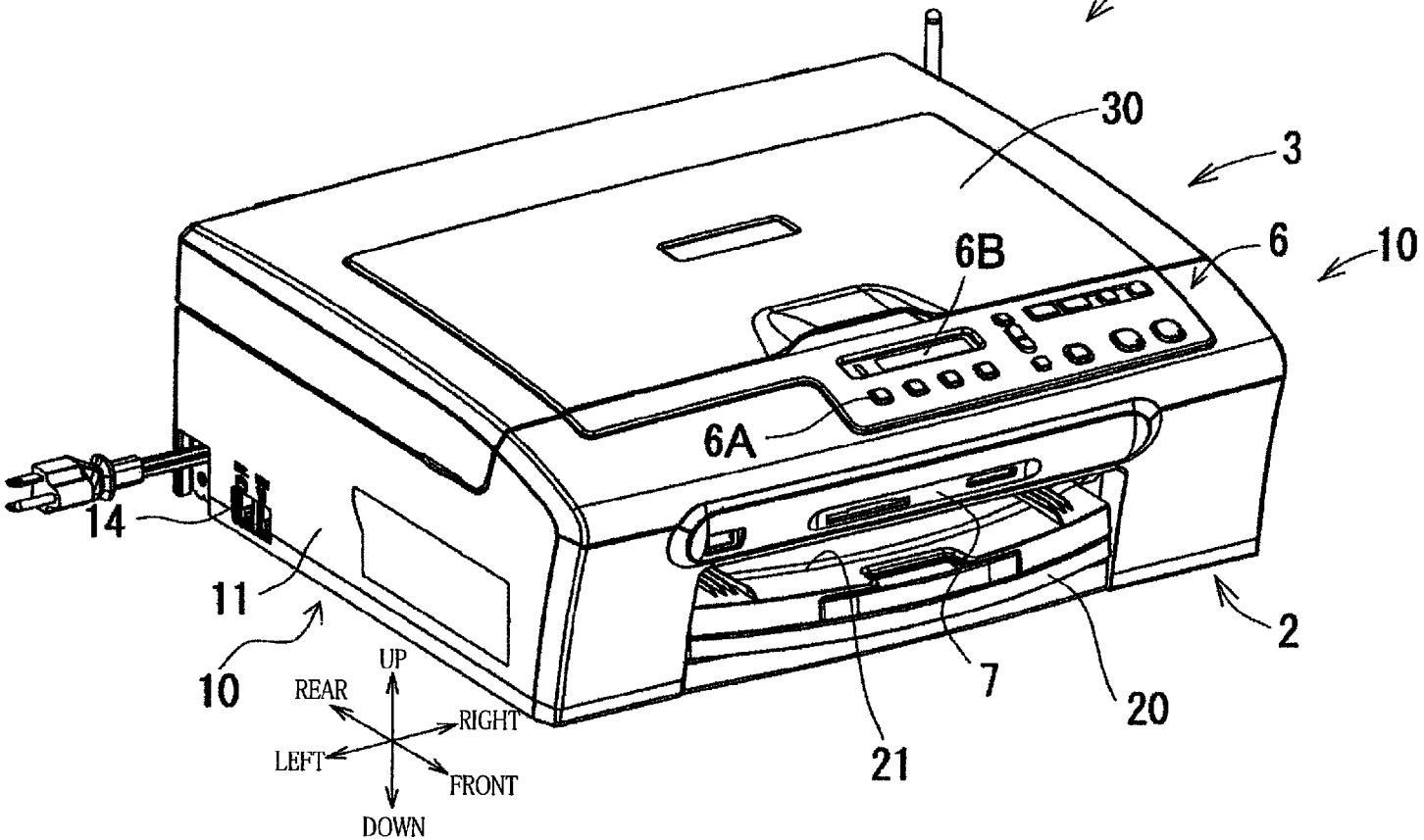
FIG. 1 is a perspective view of a multifunction device constructed according to an embodiment of the present invention.

Referring to the accompanying drawings, there will be described an opening and closing assembly in the form of a multifunction device (MFD) 1 that is constructed according to an embodiment of the present invention. The multifunction device 1 is arranged to perform various functions such as printer, scanner, copier, telecommunication and facsimile functions. As shown in FIG. 1, the multifunction device 1 has a main body 10 that is provided by a generally rectangular parallelepiped body. A height of the main body 10 is smaller than a width and a depth of the main body 10. The main body 10 has a first casing body in the form of a printer unit 2 and a second casing body in the form of a flatbed scanner unit (hereinafter referred to as FBS unit) 3. The printer unit 2 serves as an image recording unit for recording an image onto a recording medium, while the FBS unit 3 superposed on the printer unit 2 serves an image reading unit for reading an image carried on an original. In the following descriptions, a width direction of the main body 10 corresponds to a direction parallel to directions indicated by arrows "RIGHT" and "LEFT" in the drawings, a depth direction of the main body 10 corresponds to a direction parallel to directions indicated by arrows "FRONT" and "REAR" in the drawings, and a vertical direction of the main body 10 corresponds to a direction parallel to directions indicated by arrows "UP" and "DOWN".

During performance of the printer function, the multifunction device 1 is connected to a computer (not shown), and the printer unit 2 is operated to record a desired image or script onto the recording medium, based on data which is transmitted from the computer and which represents the desired image or script. Further, the multifunction device 1 may be connected also to an external device such as a digital camera or a data storage medium such as a memory card, so that the printer unit 2 can be operated to record a desired image onto the recording medium, based on data which is transmitted from the external device or the data storage medium and which represents the desired image.

During performance of the scanner function, an image or script carried on an original is read by the FBS unit, and data representative of the read image or script is transmitted to the computer or is stored into the data storage medium such as the memory card. During performance of the copier function, the printer unit 2 is operated to record the image or script (read by the FBS unit 2) onto the recording medium. During performance of the facsimile function, the data representative of the image or script (read by the FBS unit 2) is transmitted via a telephone line (not shown) that is connected to the multifunction device 1, and the printer unit 2 is operated to record an image or script onto the recording medium, based on data which is received via the telephone line. During performance of the telecommunication function, a voice can be received and transmitted via the telephone line. As shown in FIG. 1, a connecting portion 14 is provided in a side surface of the main body 10, so that the telephone line can be connected to the multifunction device 1 via the connecting portion 14.

Figure 3:
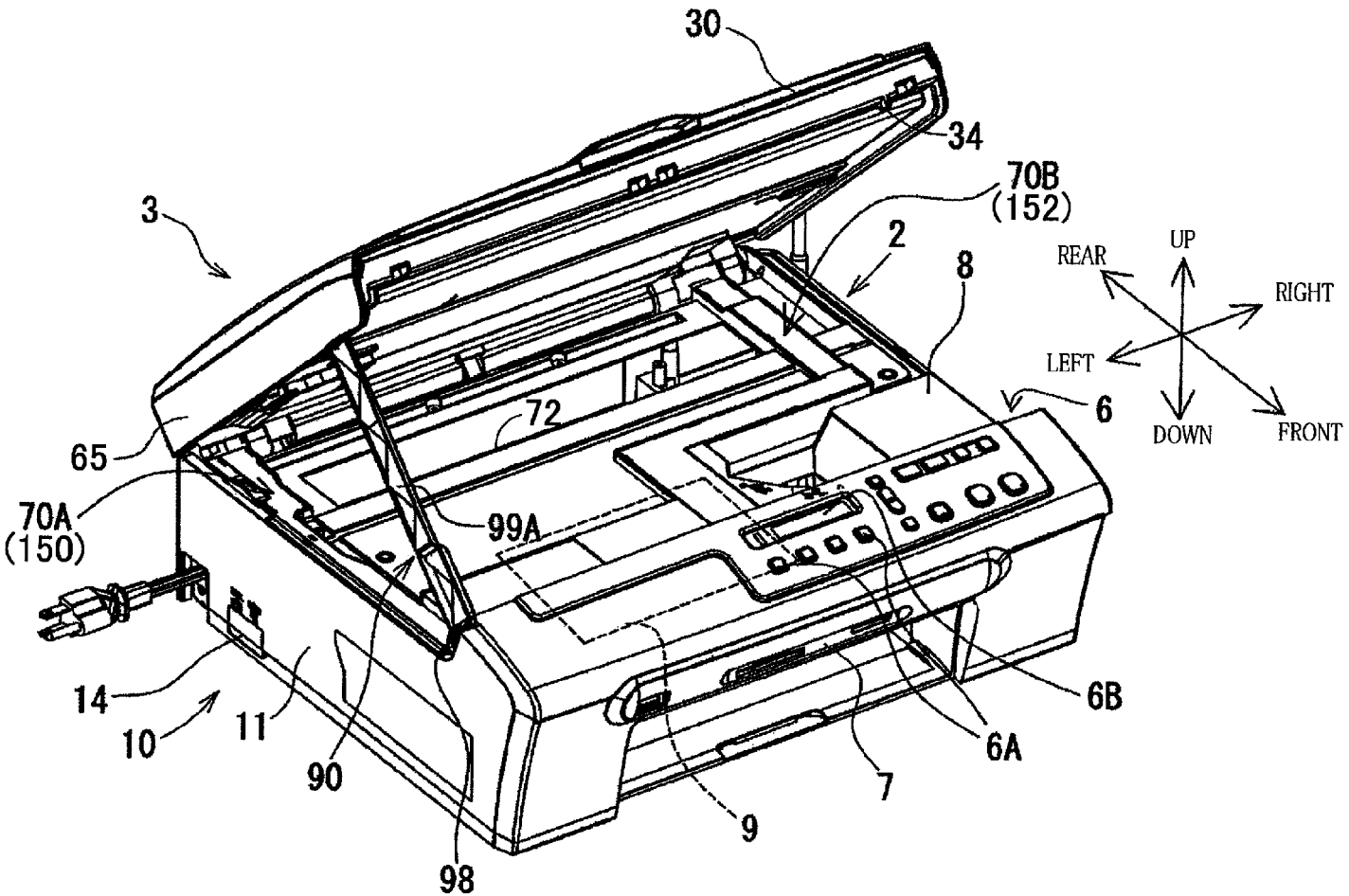
FIG. 3 is a perspective view showing the multifunction device of FIG. 1 in a state in which a flatbed scanner unit (FBS unit) is opened relative to a printer unit.
Figure 8:
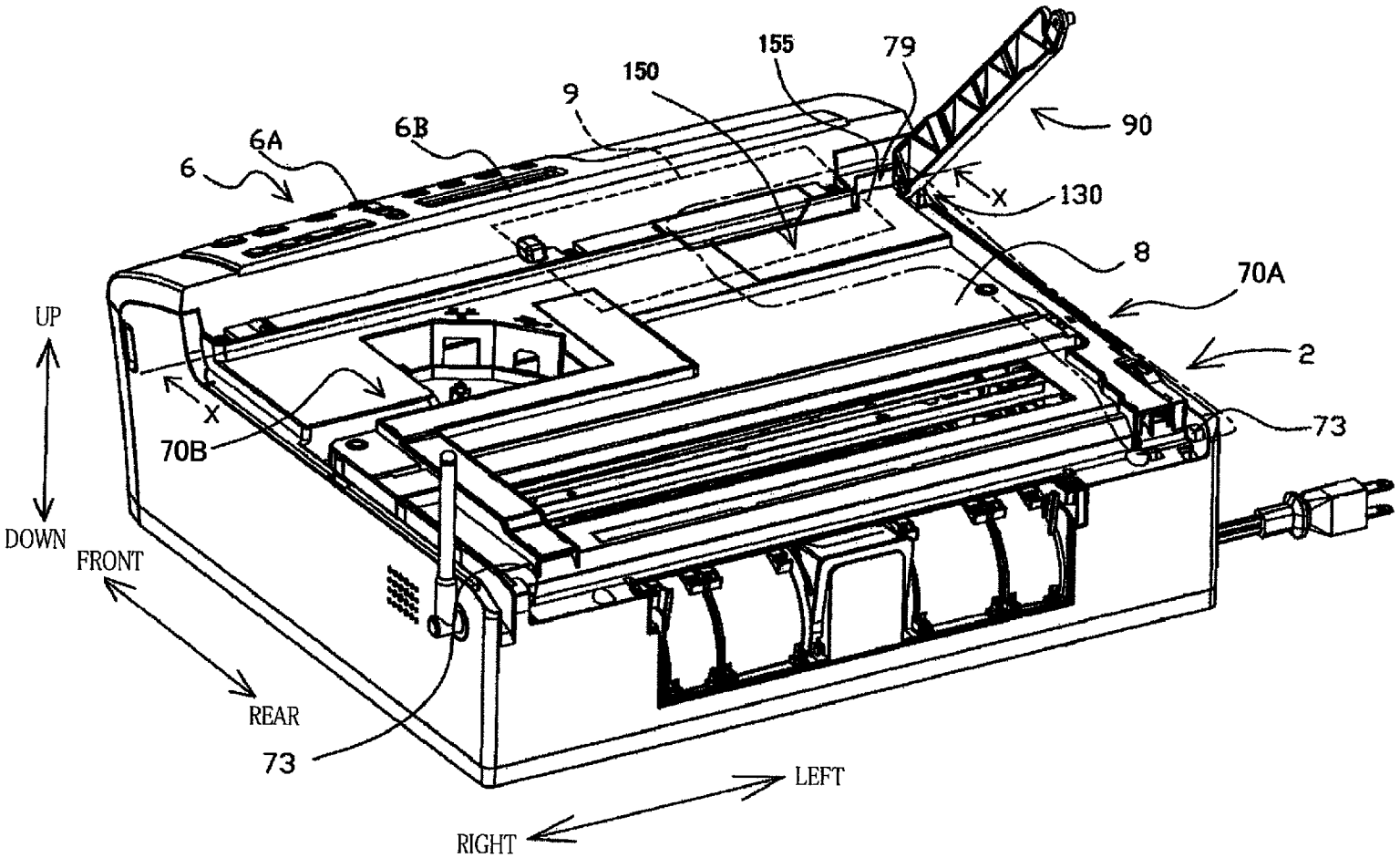
FIG. 8 is a perspective view of the printer unit, as seen from a rear side of the printer unit, for showing connection of a support stand with the printer unit.

As shown in FIGS. 3 and 8, a control circuit board 9 is provided in a front portion of an inside of the printer unit 2, so as to control operations of the printer unit 2 and the FBS unit 3.

Figure 2:
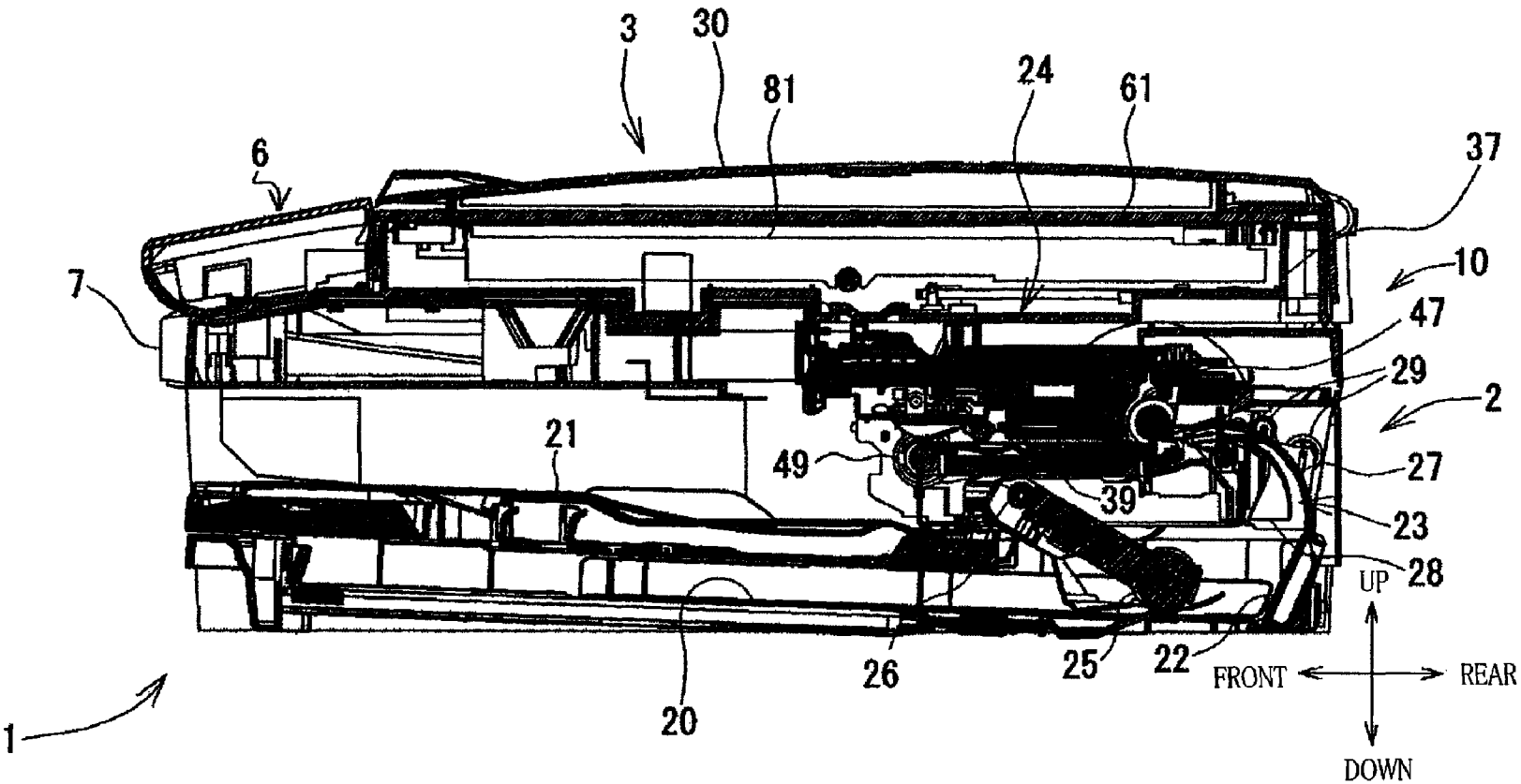
FIG. 2 is a side view in cross section of the multifunction device of FIG. 1.

As shown in FIGS. 1 and 2, a sheet supply tray 20 is provided in a bottom portion of the main body 10. The sheet supply tray 20 is removable from the main body 10 and introducible into the main body 10, by displacing the tray 20 relative to the body 10 in a forward direction and a rearward direction, respectively. The sheet supply tray 20 accommodates desired-sized recording sheets such as A4-sized paper sheets and B5-sized paper sheets that are stacked on each other. A sheet exist tray 21 is superposed on the sheet supply tray 20, and is supported by the sheet exit tray 21. The sheet supply tray 20 and the sheet exist tray 21 cooperate with each other to constitute a cassette tray assembly. When the cassette tray assembly is introduced into the main body 10 and is positioned in a predetermined position, the recording sheets can be sequentially drawn out by a sheet supply roller 25 rearwardly (as seen in FIG. 2) so as to be fed in a feed direction along a sheet feed path 23 toward an image recording unit 24. That is, the recording sheets accommodated in the sheet supply tray 20 are supplied one by one toward an inside of the printer unit 2 so as to be subjected to an image recording operation, and are then discharged to a sheet exist tray 21.

A slant sheet-separator plate 22 is disposed in a rear end portion of the sheet supply tray 20. The slant sheet-separator plate 22, which is inclined toward a rear side of the main body 10, serves to separate an uppermost one of the recording sheets from the other sheets and to guide the separated recording sheet upwardly along the sheet feed path 23. As shown in FIG. 2, the sheet feed path 23 extends upwardly from the slant sheet-separator plate 22, and is then curved forwardly so as to extend toward a front side of the main body 10. While forwardly extending up to the sheet exist tray 21, the sheet feed path 23 passes through the image recording unit 24. The recording sheets accommodated in the sheet supply tray 20 are guided by the sheet feed path 23 so as to make U turn and reach the image recording unit 24. After having been subjected to the image recording operation performed by the image recording unit 24, the recording sheets are discharged to the sheet exist tray 21.

The FBS unit 3 is provided by an upper portion of the main body 10. As shown in FIG. 2, the main body 10 has a document cover 30 which serves as a top board of the main body 10 and which is arranged to be freely openable. Below the document cover 30, there are disposed a platen glass 61 and a contact image sensor (hereinafter referred to as "CIS") 81. The CIS 81 is disposed below the platen glass 61, and is arranged such that its main scanning direction corresponds to the depth direction of the main body 10. The CIS 81 is reciprocatable in forward and rearward directions (i.e., toward the front side of the main body 10 and the rear side of the main body 10), so as to read an image carried on an original that is set on the platen glass 61.

The main body 10 has an operator's control panel 6 so that the printer unit 2 and the FBS unit 3 are operable through the operator's control panel 6. The control panel 6 is disposed on a front upper portion of the main body 10, and includes various operating buttons 6A and a liquid crystal display 6B, so that the printer unit 2 and the FBS unit 3 can be operated in accordance with commands inputted through the operating buttons 6A. Where the main body 10 is connected to a computer as an external device, the printer unit 2 and the FBS unit 3 can be operated also in accordance with commands supplied from the computer via a printer driver and a scanner driver, respectively, which are installed in the computer.

The main body 10 has a slot portion 7 that is disposed on a front side portion of the main 10 so that various small-sized memory cards as data storage media can be inserted into the slot portion 7. With a predetermined operation being carried out in the control panel 6, an image data stored in the small-sized memory cars (that are inserted in the slot portion 7) is read out. Information relating to the read image data is displayed, for example, in the liquid crystal display 6B, and the printer unit 2 is operated to record an image onto a recording sheet, which image is selected by operation of the operating buttons 6A.

As shown in FIG. 3, the FBS unit 3 as the second casing body is pivotable relative to the printer unit 2 as the first casing body. That is, the FBS unit 3 can be pivotably opened and closed relative to the printer unit 2, with its front end portion and rear end portion serving as a free end and a pivotal proximal end, respectively. In other words, the printer unit 2 has a connected portion provided by its rear portion and a distant portion provided by its front portion and distant from the connected portion, while the FBS unit 3 has a connected portion provided by its rear portion and a distant portion provided by its front portion and distant from the connected portion, such that the FBS unit 3 is connected at its connected portion to the connected portion of the printer unit 2 and is pivotable about the connected portions of the respective printer unit 2 and the FBS unit 3 relative to the printer unit 2 so as to be selectively placed in open and closed positions relative to the printer unit 2. The printer unit 2 and the FBS unit 3 are connected to each other through a pair of pivot shafts 73 (see FIG. 8) provided in the printer unit 2 and a pair of pivot shaft receivers 63 (see FIG. 7) provided in a casing 65 of the FBS unit 3. When the FBS unit 3 is opened relative to the printer unit 2, an upper surface of the printer unit 2 is exposed. However, the control circuit board 9 is not exposed since the printer unit 2 is covered by a cover body 8, as shown in FIG. 3. The cover body 8 has an opening through which a part of the inside of the printer unit 2 is exposed so that recording sheets jammed in the printer unit 2 can be removed through the opening. It is noted that the operator's control panel 6 is fixedly disposed in the printer unit 2 and is not movable together with the FBS unit 3.

There will be described a construction of the printer unit 2 in detail.

As shown in FIG. 2, the sheet supply roller 25 is disposed above the sheet supply tray 2, so as to separate one by one the recording sheets stacked on the sheet supply tray 20 and supply toward the sheet feed path 23. The sheet supply roller 25 is rotatably held by a distal end portion of a sheet supply arm 26 that is vertically displaceable toward and away from the sheet supply tray 20. The sheet supply roller 25 is rotated by a drive force transmitted from a motor (not shown).

The sheet supply arm 26 is pivotable about its proximal end portion for causing its distal end portion to be vertically displaced. While the sheet supply tray 20 is disposed in the main body 10, the sheet supply roller 25 lowered by the sheet supply arm 26 is forced toward the sheet supply tray 20. When the sheet supply tray 20 is removed from the main body 10, the sheet supply arm 26 is pivoted by a biasing force of a spring (not shown) in a direction that causes the sheet supply roller 25 to be displaced upwardly. When the sheet supply arm 26 is pivoted in a direction that causes the sheet supply roller 25 to be displaced downwardly, the sheet supply roller 25 is brought into pressing contact with the recording sheets stacked on the sheet supply tray 20. Thus, with rotation of the sheet supply roller 25, an uppermost one of the recording sheets is moved toward the slant sheet-separator plate 22, owing to a frictional force generated between a surface of the sheet supply roller 25 and the upper most recording sheet. The moved recording sheet is brought into contact at its leading end with the slant sheet-separator plate 22, and is upwardly guided by the sheet-separator plate 22 so as to be fed to the sheet feed path 23. In this instance, even if the second uppermost recording sheet were about to be fed together with the uppermost recording sheet due to a frictional force or static electricity generated between the first and second uppermost recording sheets, the second uppermost recording sheet comes into contact with the slant sheet-separator plate 22 whereby the feed movement of the second uppermost recording sheet is stopped by the sheet-separator plate 22.

The sheet feed path 23 is defined by outside and inside guide surfaces that are spaced apart from each other, except its portions in which the image recording unit 24 and the other functional units are disposed. For example, the sheet feed path 23 includes a portion which is located in a rear side portion of the multifunction device 1 and which is defined between an outside guide member 27 and an inside guide member 28 that are fixed to a frame of the main body 10. In a curved portion of the sheet feed path 23, a feed roller 29 is disposed in the outside guide member 27 for facilitating the feed movement of the recording sheet, which is brought into contact with an inner surface of the outside guide member 27 in the curved portion of the sheet feed path 23. The feed roller 29 is supported by the outside guide member 27 such that the feed roller 29 is freely rotatable about an axis parallel to a width direction of the sheet feed path 23 and such that a peripheral surface of the feed roller 29 protrudes from the inner surface of the outside guide member 27.

Figure 4:
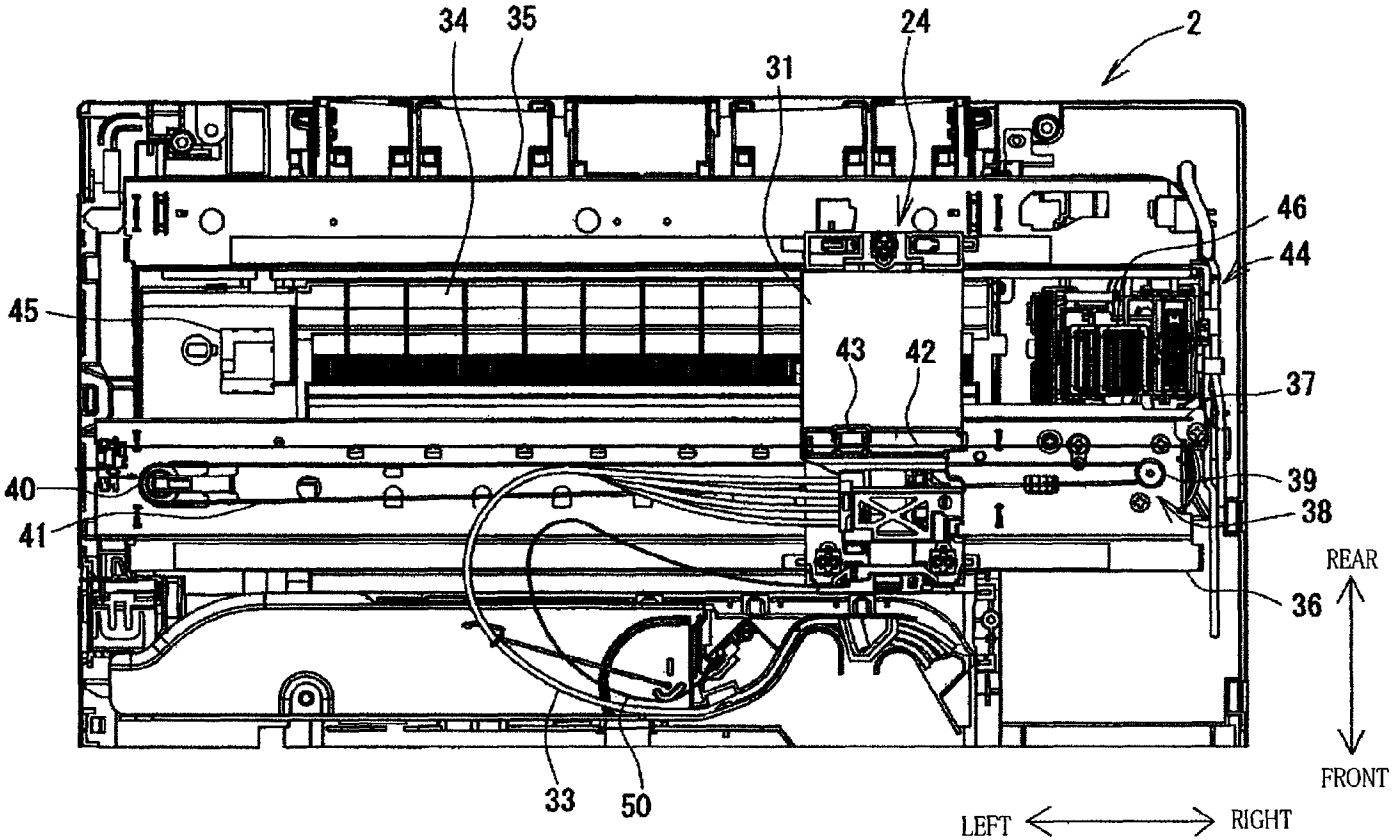
FIG. 4 is a plan view showing a main portion of the printer unit of the multifunction device of FIG. 1.

FIG. 4 is a plan view showing a main portion of the printer unit 2. The image recording unit 24 includes a head carriage 31 which carries a recording head and which is reciprocatable in a main scanning direction. To the recording head, color inks such as cyan (C), magenta (M), yellow (Y) and black (Bk) color inks are supplied from respective ink tanks (not shown) via respective ink tubes 33. The recording head exposed in a lower surface of the head carriage 31, and is operable to eject the color inks in the form of small ink droplets. With reciprocating movement of the head carriage 31, the recording head is moved relative to the recording sheet that is fed on a platen 34 and performs an image recording operation onto the recording sheet.

As shown in FIG. 4, a pair of guide rails 35, 36 are disposed above the platen 34. The guide rails 35, 36 extend in the width direction of the sheet feed path 23 and are spaced apart from each other in the feed direction of the recording sheets. The head carriage 31 is arranged to straddle the guide rails 35, 36 so as to be slidable on the guide rails 35, 36. The guide rail 35, which is an upstream one of the guide rails 35, 36 as viewed in the sheet feed direction, is provided by a plate-like member having a length (as measured in the width direction of the sheet feed path 23) that is larger than a scanning width of the head carriage 31. The head carriage 31 is slidably held at its upstream end portion by an upper surface of the guide rail 35.

The guide rail 36, which is a downstream one of the guide rails 35, 36 as viewed in the sheet feed direction, is provided by another plate-like member having substantially the same length of the guide rail 35. The head carriage 31 is slidably held at its downstream end portion by an upper surface of the guide rail 36. An upstream end portion 37 of the guide rail 36 is bent by substantially a right angle so as to upwardly extend. The upstream end portion 37 of the guide rail 36 is gripped between a pair of rollers (not shown) of the head carriage 31. The head carriage 31 is slidably held by the guide rails 35, 36 and is reciprocatable in the width direction of the sheet feed path 23, with the end portion 37 of the guide rail 36 serving as a reference portion.

A belt drive mechanism 38 is disposed on an upper surface of the guide rail 36. The belt drive mechanism 38 includes a drive pulley 39 and a driven pulley 40 that are disposed in respective widthwise opposite end portions of the sheet feed path 23, and an endless timing belt 41 having tooth formed in its inside surface. The endless timing belt 41 is wound on the drive and driven pulleys 39, 40, with a predetermined degree of tension being given to the timing belt 41. With rotation of the drive pulley 39 caused by a drive force of a motor that is applied to a shaft of the drive pulley 39, the timing belt 41 is circulated.

The head carriage 31 is fixed to a portion of the timing belt 41 so that the head carriage 31 is movable on the guide rails 35, 36 by the circulating motion of the timing belt 41. The recording head carried by the head carriage 31 is reciprocatable together with the head carriage 31 in the main scanning direction, i.e., in the width direction of the sheet feed path 23. The guide rail 36 is provided with an encoder strip 42 that is disposed on the end portion 37 of the guide rail 37. The encoder strip 42 cooperates with a photo interrupter 43 (that is provided in the head carriage 31 and arranged to detect the encoder strip 42) to constitute a linear encoder. The reciprocating movement of the head carriage 31 is controlled based on a detection signal supplied by the linear encoder.

As shown in FIG. 4, the platen 34 is disposed in a position opposed to the head carriage 31 in the vertical direction. The recording sheet passes over a central region of a stroke range of the head carriage 31. The platen 34 is arranged to extend over the central range. It is noted that the platen 34 has a width sufficiently larger than a width of a maximum-sized recording sheet that can be used in the present multifunction device 1 so that widthwise opposite ends of the recording sheet pass over the platen 34.

A purging device 44 and a waste ink tray 45 are disposed in respective positions outside a printing area (within which the recording head is moved for achieving the recording operation), namely, in respective positions corresponding to opposite end portions of the platen 34 (over which the recording sheet does not pass). The purging device 44 is operated to perform a purging operation for sucking poor-quality ink, bubbles and foreign matters so as to remove them from nozzles of the recording head. The purging device 44 has a purge cap 46 that is provided to cover a nozzle-defining surface of the recording head. The purge cap 46 is vertically movable by a movement device, toward and away from the nozzle-defining surface of the recording head. In a purging operation with the purging device 44, the head carriage 31 is moved to position the recording head in a position right above the purge cap 46, and the purge cap 46 is then moved upwardly to be brought into close contact with the nozzle-defining surface of the recording head so as to close the nozzles. With activation of a pump that is connected to the purge cap 46, the ink, bubbles and foreign matters are sucked from the nozzles.

The waste ink tray 45 is disposed in one of the above-described positions that is opposite to the purging device 44, so as to receive poor-quality ink which is flushed in a flushing operation, namely, which is ejected apart from the recording operation performed onto the recording sheet. The purging device 44 and the waste ink tray 45 cooperate to constitute a maintenance unit for removing mixed ink and bubbles from the nozzles and from an inside of the recording head.

From the above-described ink tanks, the four color inks are supplied to the recording head carried by the head carriage 31, via the respective four ink tubes 33. The ink tanks store therein the cyan (C), magenta (M), yellow (Y) and black (Bk) color inks, respectively, independently of each other, and cooperate with each other to constitute an ink tank unit.

Each ink tube 33 is formed of a synthetic resin and has a flexibility to be bent so as to follow the reciprocating movement of the head carriage 31. One opening end portion of the ink tube 33 is attached to a corresponding one of the ink tanks, while the other opening end portion thereof is attached to the head carriage 31. The ink tube 33 extends in the width direction of the main body 10 from the corresponding ink tank to a widthwise central portion of the main body 10, and is attached at its intermediate fixed portion to a suitable member such as the frame of the main body 10. The ink tube 33 is not attached to the frame or the other member at its portion between the intermediate fixed portion and the above-described other opening end portion (that is attached to the head carriage 31), so that a shape of the non-attached portion is changeable according to the reciprocating movement of the head carriage 31. Described specifically, as the head carriage 31 is moved in a leftward direction as seen in FIG. 4, a radius of curvature of a U-shaped curved portion of the ink tube 33 becomes smaller. On the other hand, as the head carriage 31 is moved in a rightward direction as seen in FIG. 4, the radius of curvature of the U-shaped curved portion of the ink tube 33 becomes larger.

As shown in FIG. 4, a flat cable 50 is connected at its end portion to the head carriage 31, and is connected at its other end portion to a control circuit board (not shown), so that the recording head can receive, from the control circuit board via the flat cable 50, signals such as those required for performing the recording operation. The flat cable 50 is a thin strip-like member containing conductors which transmit electric signals and which are covered by a synthetic resin film such as polyester film so as to insulate the conductors from each other. The control circuit board and a circuit board provided in the recording head are electrically connected by the flat cable 50. The flat cable 50 is led out of the head carriage 31 in a direction parallel to the reciprocating movement of the head carriage 31, and includes a substantially U-shaped portion that is curved on a horizontal plane. The U-shaped portion of the flat cable 143 is not fixed to any other members, and accordingly changes its shape in accordance with the reciprocating movement of the head carriage 31.

As shown in FIG. 2, a sheet feed roller 47 is provided on an upstream side of the image recording unit 24. On a lower side of the sheet feed roller 47, a pinch roller (not shown) is provided to be in pressing contact with the sheet feed roller 47. The sheet feed roller 47 cooperates with the pinch roller to nip the recording sheet so as to feed the recording sheet toward above the platen 34. Meanwhile, a sheet discharge roller 49 is provided on a downstream side of the image recording unit 24. On an upper side of the sheet discharge roller 49, a pinch roller is provided to be in pressing contact with the sheet discharge roller 49. The sheet discharge roller 49 cooperates with the pinch roller to nip the recording sheet (that has been subjected to the recording operation) so as to feed the recording sheet toward the sheet exit tray 21. Each of the sheet feed roller 47 and the sheet discharge roller 49 is intermittently driven or rotated by a motor, so as to feed the recording sheet, with an amount of each intermittent motion of the recording sheet corresponding to an amount of line feed. The sheet feed roller 47 and the sheet discharge roller 49 are rotated in synchronization with each other. A photo interrupter (not shown) is provided to detect marks or slits of an encoder disk (not shown) that is rotated together with the sheet feed roller 47. That is, the photo interrupter and the encoder disk cooperate with each other to constitute a rotary encoder to generate signals corresponding to the detected slits of the encoder disk. The rotations of the sheet feed and discharge rollers 47, 49 are controlled based on the signals generated by the rotary encoder.

There will be described a construction of the FBS unit 3 in detail.

As shown in FIG. 2, the document cover 30 of the FBS unit 3 is provided to be pivotable relative to the main body 10 through a hinge that is provided in a rear portion of the main body 10. The document cover 30 constitutes a part of an upper surface of the multifunction device 1 in a state in which the document cover 30 is closed relative to the main body 10. The document cover 30 may be provided with an automatic document feeder (ADF).

As shown in FIG. 2, with the document cover 30 being closed relative to the main body 10, the platen glass 61 is covered by the document cover 30. A lower surface of the document cover 30 is provided by a presser member (not shown) including a sponge and a white board. The plate glass 61, on which an original document is to be set so as to be scanned, is provided by, for example, a transparent glass or acryl plate. The platen glass 61 has a size that permits the original document whose size is not larger than A4-sized sheet or legal-sized sheet, to be set thereon. The original document set on the platen glass 61 is fixed on the plate glass 61 with the document cover 30 that is closed relative to the main body 10. While the original document is being thus fixed on the plate glass 61, an image reader 80 (see FIG. 5) is moved along the platen glass 61 whereby an image carried on the original document is read by the FBS unit 3.

Figure 5:
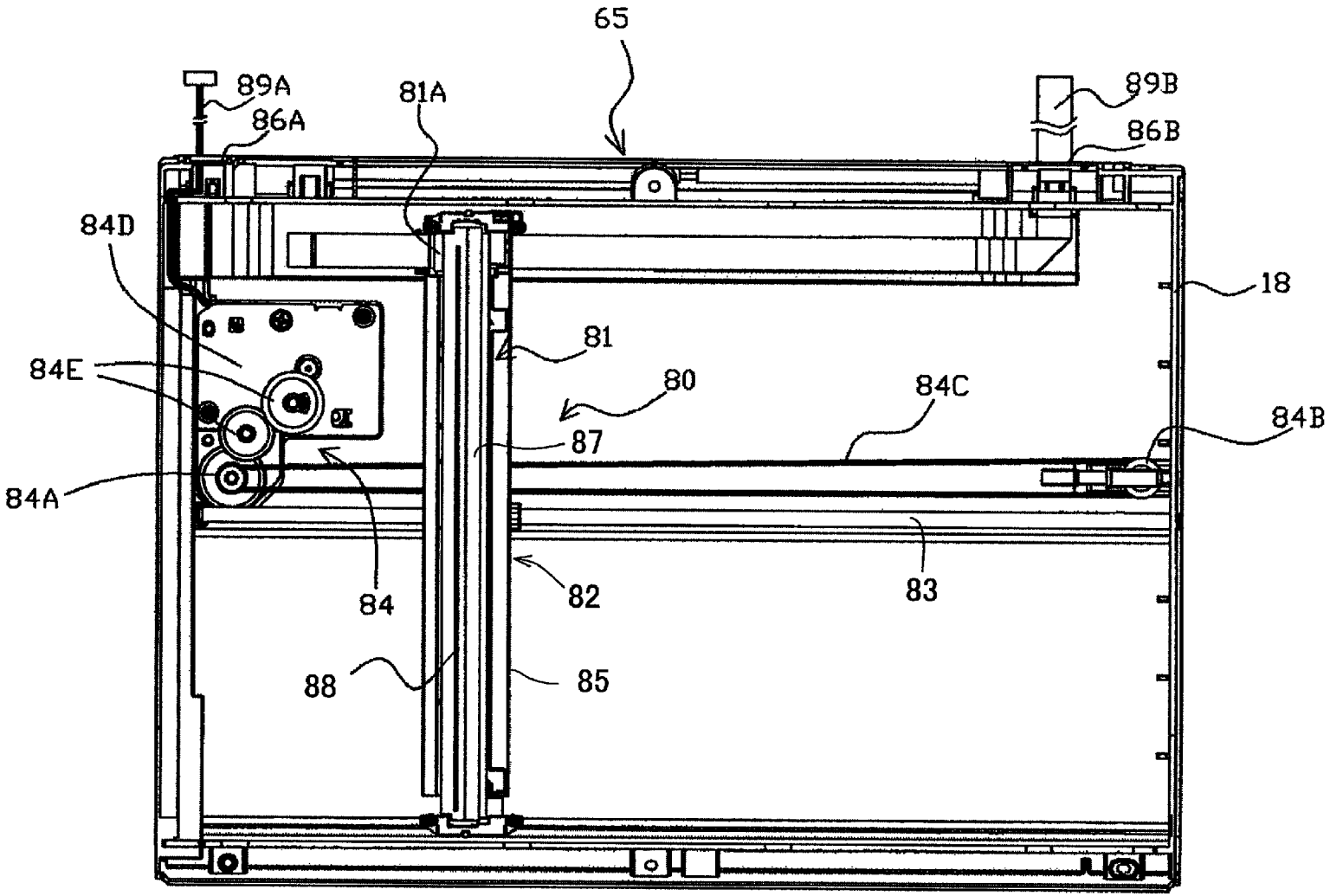
FIG. 5 is a plan view showing a main portion of the FBS unit of the multifunction device of FIG. 1.

FIG. 5 is a plan view showing an internal construction of the FBS unit 3, with an upper cover of the FBS unit 3 being cut away therefrom.

The image reader 80 is disposed inside the casing 65 that is provided with a plurality of support ribs 18 for supporting the platen glass 61. The support ribs 18 are positioned to surround an area within the image reader 80 is movable. The platen glass 61 is held horizontal by the support ribs 18. With the above-described upper cover being attached, a portion of the platen glass 61 is exposed through an opening of the upper cover. The exposed portion of the platen glass 61 corresponds to an image reading area (in which an image is readable by the FBS unit 3).

The image reader 80 includes a carriage 82, a guide rod 83 and a belt drive mechanism 84 in addition to the above-described CIS 81. Since the CIS 81 is used in the image reader 80, the image reader 80 as a whole can be made compact in size with a light weight thereby making it possible to reduce a size and a thickness of the FBS unit 3.

The CIS 81 has an elongated rectangular casing body 85 whose upper surface has an elongated rectangular shape as seen in its plan view. On the upper surface of the elongated rectangular casing body 85, there is provided a light guide 87 extending in a longitudinal direction of the casing body 85, for guiding a light of LED incorporated in the casing body 85. The light of the LED is emitted through the light guide 87 toward the upper surface of the casing body 85 of the CIS 81 along the longitudinal direction. On the upper surface of the casing body 85, a plurality of condenser lenses 88 are arranged in a row that extends in the longitudinal direction of the casing body 85 so as to be parallel to the light guide 87.

Inside the case 30, a plurality of light receiving elements are arranged, right below the respective condenser lenses 88, in a row extending in the same direction as the direction of extension of the row of the condenser lenses 88. The light emitted from the LED is reflected on the original document placed on the platen glass 61, and the reflected light is condensed at the light receiving elements by the condenser lenses 88. The light receiving elements are so-called photoelectric conversion elements which output electric signals in accordance with the intensity of the reflected light. The longitudinal direction of the casing body 85 of the CIS 81 corresponds to a main scanning direction in the image reading. The length of the casing body 85 of the CIS 81 in the main scanning direction, i.e., the longitudinal size of the casing body 85, corresponds to a length of a maximum-sized original document that can be read by the CIS 81. The CIS 81 performs image reading along a read line corresponding to the longitudinal direction of the casing body 85 of the CIS 81 and outputs electric signals for every read line. In the present embodiment, since A4-sized or legal-sized paper sheet can be set as the maximum-sized original document on the platen glass 61, the read line has a length corresponding to the length of the A4-sized or legal-sized paper sheet.

The carriage 82 is provided by a vessel-like member that carries the CIS 81 disposed thereon. The carriage 82 has an upper opening end through which an upper surface of the CIS 81 carried on the carriage 82 is exposed. The carriage 82 is slidably fitted on the guide rod 83, and is moved by the belt drive mechanism 84 to be slid along the guide rod 83. The CIS 81 carried by the carriage 82 is held in close contact with the platen glass 61, and is reciprocated by sliding movement of the carriage 82 along the guide rod 83, in parallel to the platen glass 61.

The belt drive mechanism 84 includes a drive pulley 84A and a driven pulley 84B that are disposed in respective longitudinally opposite end portions (in respective left and right end portions as seen in FIG. 5) of the FBS unit 3, and an endless timing belt 84C having tooth formed in its inside surface. The endless timing belt 84C is wound on the drive and driven pulleys 84A, 84B, with a predetermined degree of tension being given to the timing belt 84C. With rotation of the drive pulley 84A that is caused by a drive force of a CIS drive motor 84D that is applied to a shaft of the drive pulley 84A via a transmission 84E, the timing belt 84C is circulated.

The carriage 82 is fixed to a portion of the timing belt 84C so that the carriage 82 is reciprocatable along the guide rod 83 by the circulating motion of the timing belt 84C. The CIS 81 carried by the carriage 82 is reciprocatable together with the carriage 82 in the main scanning direction, i.e., in the width direction of the sheet feed path 23.

As shown in FIG. 5, a wire harness 84A is connected at one of its opposite end portions to the CIS drive motor 84D of the belt drive mechanism 84. The wire harness 84A extends out of the FBS unit 3 through a harness outlet 86A that is provided in a rear left portion of the FBS unit 3, so that the other of the opposite end portions of the wire harness 84A is connected to the above-described control circuit board 9 (see FIG. 3) that is provided in the front portion of the inside of the printer unit 2. In the cover body 8 covering the printer unit 2, there is formed an accommodating portion 70A. The wire harness 84A extending from the FBS unit 3 is accommodated in the accommodating portion 70A, and is connected at the above-described other end portion thereof to the control circuit board 9. Thus, the drive motor 84D of the belt drive mechanism 84 and the control circuit board 9 are connected through an electric path through which drive signals and an electric power required for driving the drive motor 84D are supplied from the control circuit 9 to the drive motor 84D.

The CIS 81 has a connector portion 81A that is provided in a longitudinal end portion of the elongated rectangular casing body 85. The connector portion 81A is electrically connected to the above-described LED and light receiving elements, so as to allow input and output of signals therethrough. A flat cable 89B is provided to be connected at one of its opposite end portions to the connector portion 81A. The flat cable 89B is a thin strip-like member containing a plurality of conductors such as a conductor for supplying an electric power to the LED of the CIS 81 and a conductor for outputting electric signals from the light receiving elements. The conductors are covered by a film insulating the conductors from each other. The control circuit board and a circuit board provided in the recording head are electrically connected by the flat cable 50.

The flat cable 89B extends out of the FBS unit 3 through a cable outlet 86B that is provided in a rear right portion of the FBS unit 3, so that the other of the opposite end portions of the flat cable 89B is connected to the control circuit board 9 (see FIG. 3) that is provided in the front portion of the inside of the printer unit 2. In the cover body 8 covering the printer unit 2, there is formed an accommodating portion 70B (see FIG. 3). The flat cable 89B extending from the FBS unit 3 is accommodated in the accommodating portion 70B, and is connected at the above-described other end portion thereof to the control circuit board 9. Thus, the CIS 81 and the control circuit board 9 are connected through an electric path.

As described above, the cover body 8 is formed with the accommodating portions 70A, 70B for accommodating therein the wire harness 89A and the flat cable 89B, respectively. Further, the cover body 8 is formed with an opening 72 for allowing an operation for recovering from a trouble such as paper jam. Therefore, the accommodating portions 70A, 70B extends from a rear end portion of the printer unit 2 to the control circuit board 9, bypassing the opening 72. In a state shown in FIG. 3, the accommodating portions 70A, 70B are closed by respective cover members 150, 152. As described below in detail, the cover member 150 cooperates with a pivot-boss receiving portion 130 (see FIGS. 8 and 9) as the above-described distant portion that is provided in an upper portion of the printer unit 2, to support a proximal end portion of a support stand 90 such that the support stand 90 is pivotable relative to the printer unit 2.

There will be described an opening and closing mechanism for opening and closing the FBS unit 3 as the second casing body relative to the printer unit 2 as the first casing body.

The support stand 90 is provided between the printer unit 2 and the FBS unit 3 (see FIG. 3), so as to maintain the open position of the FBS unit 3 when the FBS unit 3 should be held in the open position. The support stand 90 is provided by a generally flat plate-like member (see FIG. 6) having a length that is slightly smaller than the depth of the main body 10. The support stand 90 includes a proximal end portion that is pivotably connected to a front upper portion of the printer unit 2 as the above-described distant portion of the printer unit 2, and a distal end portion 94 that is slidably connected to the casing 65 of the FBS unit 3. While maintaining the open position of the FBS unit 3, the support stand 90 extends in a diagonal direction, as shown in FIG. 3.

Figure 6:
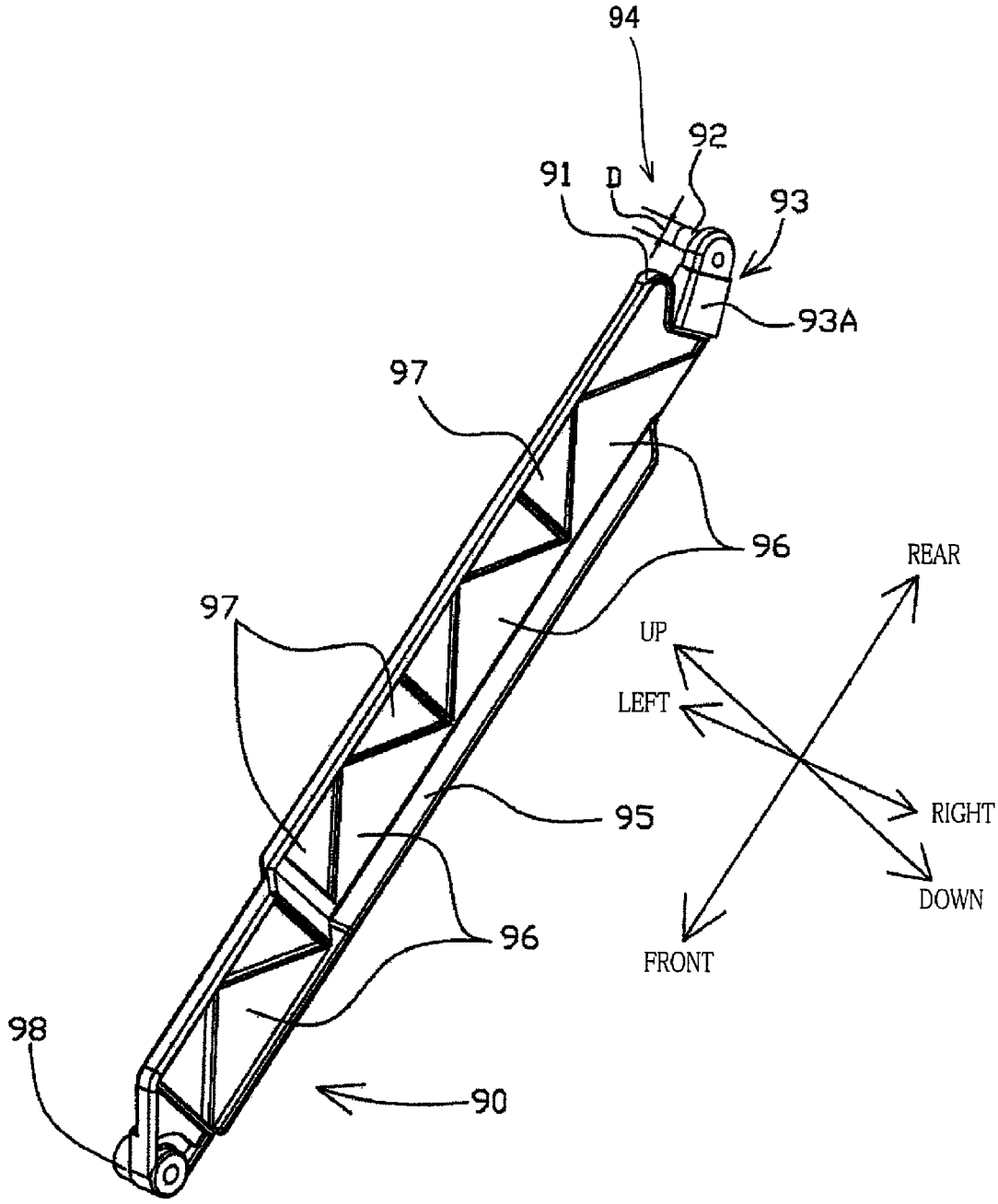
FIG. 6 is a perspective view of a support stand of the multifunction device of FIG. 1.

The support stand 90 is provided by a flat plate-like member formed of a synthetic resin. The support stand 90 is attached to the main body 10 such that a width direction of the support stand 90 is perpendicular to the width direction of the main body 10. In FIG. 6 as a perspective view showing the support stand 90, there are indicated upper, lower, right, left, front and rear directions of the main body 10 in a state in which the support stand 90 is in a horizontal posture that allows the printer unit 2 to be placed in its closed position relative to the FBS unit 3. The support stand 90 has, in its proximal end portion, a pivot boss 98 that projects from a left-side surface 99A (see FIG. 10) of the support stand 90. The pivot boss 98 is received in the pivot-boss receiving portion 130 provided in the printer unit 2, so that the proximal end portion of the support stand 90 is pivotably connected to the printer unit 2.

The support stand 90 has, in its bottom portion, a rib 95 extending over substantially an entire length of the stand 90, as shown in FIG. 6. The rib 95 projects from a bottom surface of the stand 90 in a thickness direction of the stand 90, so as to constitute an extension of the bottom surface of the stand 90. Owing to the rib 95, a stiffness of the support stand 90 is increased.

The support stand 90 includes thick-walled portions 96 provided in its opposite side surfaces (left-side and right-side surfaces 99A and 99B) and protruding in the thickness direction, as shown in FIG. 6. The thick-walled portions 96 each having a triangular shape are arranged in a longitudinal direction of the stand 90. Some of the thick-walled portions 96, provided in the right-side surface 99B (one of the opposite side surfaces) that is visible in FIG. 6, are arranged such that a base of the triangular shape of each thick-walled portion 96 is located on the side of the bottom surface of the stand 90 and such that a vertex of the triangular shape of each thick-walled portion 96 is located on the side of a top surface of the stand 90. Although not being visible in FIG. 6, the others of the thick-walled portions 96 are provided in the left-side surface 99A (the other side surface) of the support stand 90.

The support stand 90 further includes thin-walled portions 97 provided in its opposite side surfaces and recessed in the thickness direction, as shown in FIG. 6. Like the thick-walled portions 96, the thin-walled portions 97 each having a triangular shape are arranged in the longitudinal direction of the stand 90. The thin-walled portions 97 and the thick-walled portions 96 are alternately arranged in the longitudinal direction of the stand 90. Some of the thin-walled portions 97, provided in the right-side surface 99B that is visible in FIG. 6, are arranged such that a base of the triangular shape of each thin-walled portion 97 is located on the side of the top surface of the stand 90 and such that a vertex of the triangular shape of each thin-walled portion 97 is located on the side of the bottom surface of the stand 90. Although not being visible in FIG. 6, the others of the thin-walled portions 97 are provided in the left-side surface 99A of the support stand 90. The above-described some of the thin-walled portions 97 provided in the right-side surface 99B are positioned in respective positions that substantially correspond to positions of the above-described other of the thick-walled portions 96 provided in the left-side surface 99A. Meanwhile, the others of the thin-walled portions 97 provided in the left-side surface 99A are positioned in respective positions that substantially correspond to positions of the above-described some of the thick-walled portions 96 provided in the right-side surface 99B, respectively. The thick-walled and thin-walled portions 96, 97 are thus arranged in a predetermined pattern, so that the support stand 90 has an improved appearance. It is noted that each of the thick-walled portions 96 is slightly larger than each of the thin-walled portions 97 such that each of the above-described some of the thick-walled portions 96 partially overlaps with a corresponding adjacent pair of the above-described others of the thick-walled portions 96. Namely, in a zigzag-shaped boundary between the thick-walled and thin-walled portions 96, 97, there are exist parts of the thick-walled portions 96 in both of the right-side and left-side surfaces 99B, 99A of the stand 90. Thus, the zigzag-shaped boundary constitute diagonal braces interconnecting the top and bottom surfaces of the stand 90, the stiffness of the support stand 90 is further increased.

The support stand 90 has an engaged portion in the form of an engaged pin 92 that is provided in the distal end portion 94. The engaged pin 92 has a circular cross sectional shape, and is engaged in an arcuate-shaped guide groove 103 (see FIG. 12) formed through a load adjuster member 100 as a grooved member, so as to be guided by the guide groove 103. The load adjuster member 100 is accommodated in an accommodating recess 68 that is formed in the casing 65 of the FBS unit 3. The engagement of the engaged pin 92 with the guide groove 103 will be described later in detail.

The support stand 90 has a supporting portion 91 that is provided also in the distal end portion 94 (see FIG. 6). The supporting portion 91 of the support stand 90 is held in contact with a supported portion 112 (see FIG. 12) of the load adjuster member 100 while the FBS unit 3 is held in its open position relative to the printer unit 2. Thus, the open position of the FBS unit 3 is maintained by the contact of the supporting portion 91 with the supported portion 112.

Figure 7:
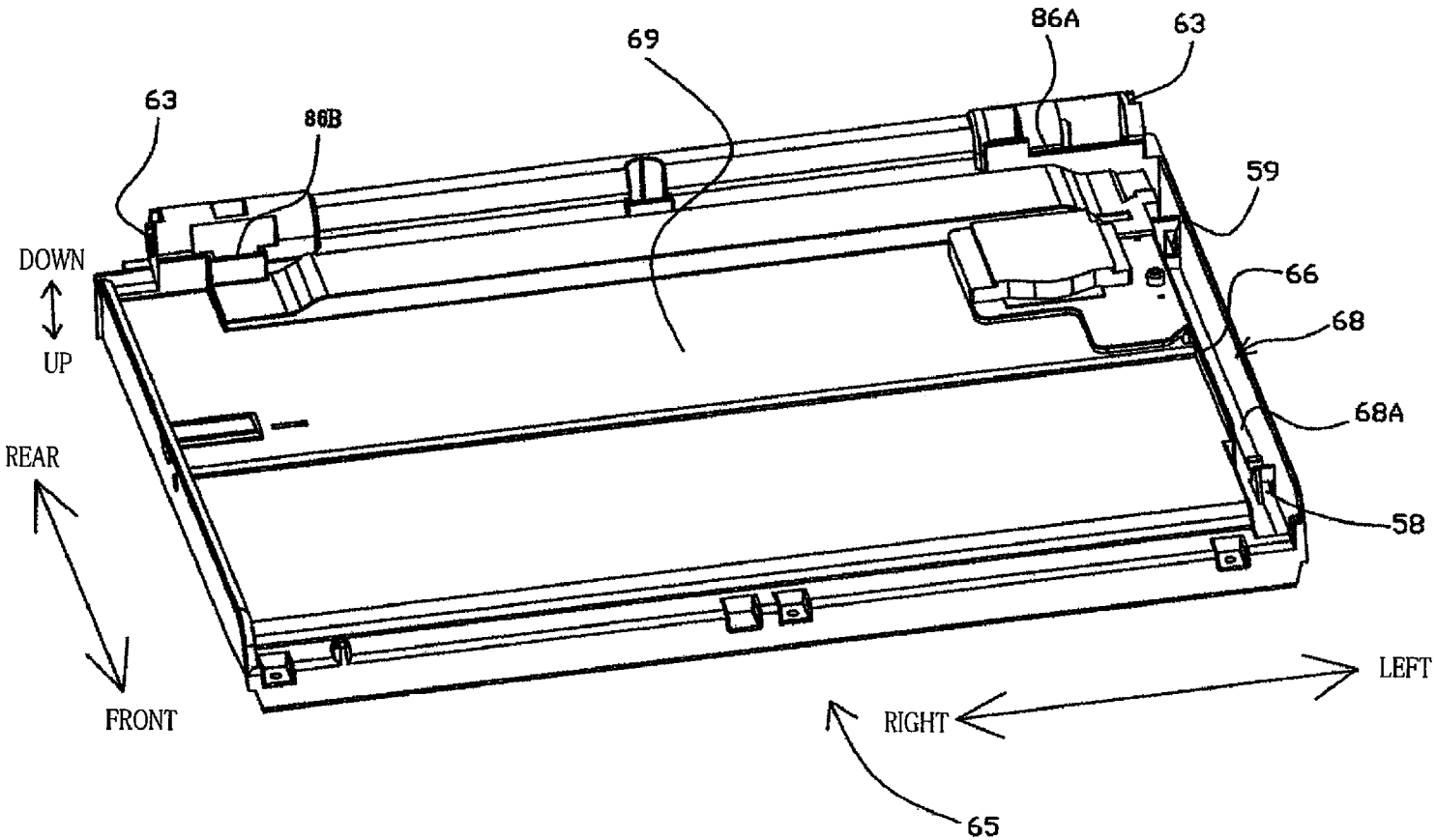
FIG. 7 is a perspective view of a casing of the FBS unit, as seen from a lower side of the casing.
Figure 11:
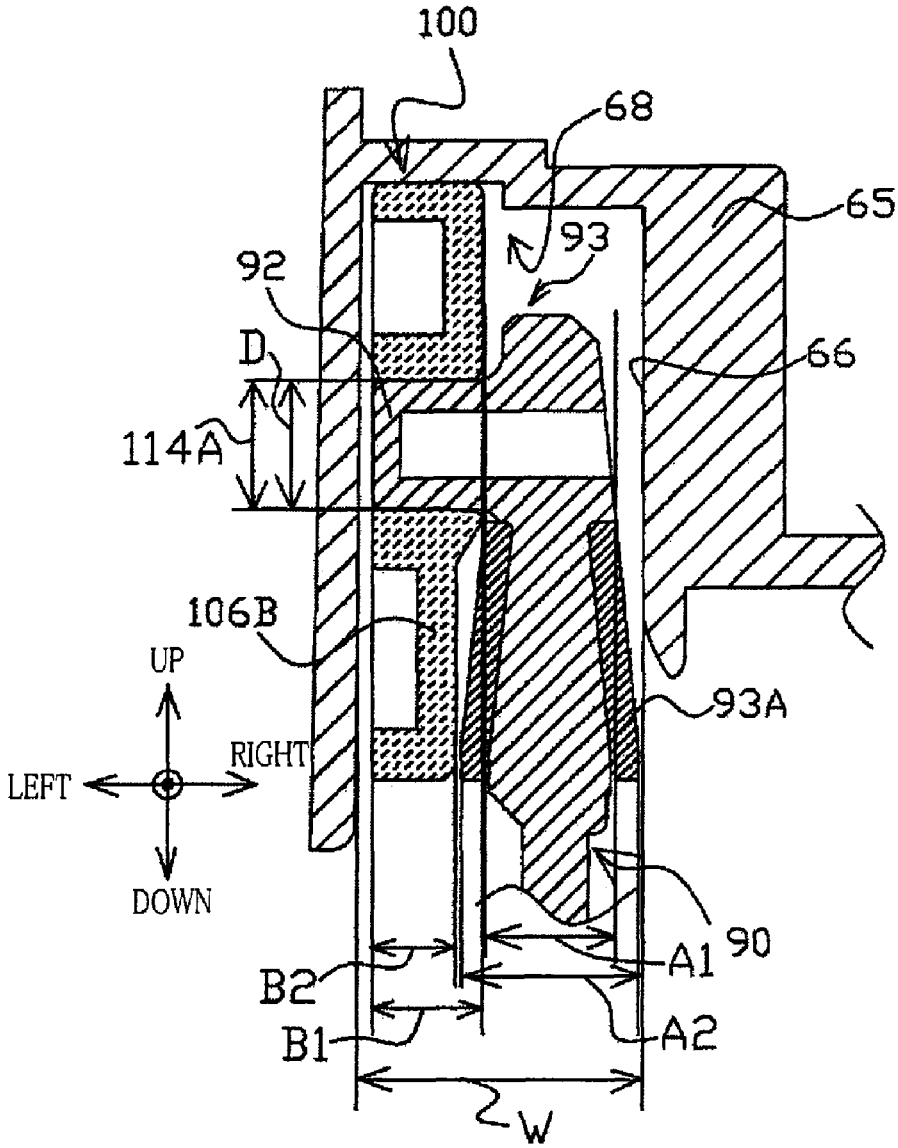
FIG. 11 is a cross sectional view showing an inside of an accommodating recess in an opening side region of a guide groove formed in a load adjuster member (that is accommodated in the accommodating recess) when the load adjuster member is placed in its fully gripping position.

FIG. 7 is a perspective view of the casing 65 of the FBS unit 3, as seen from a lower side of the casing 65. In FIG. 7, there are indicated upper, lower, right, left, front and rear directions of the main body 10 in a state in which the FBS unit 3 is attached to the printer unit 2. As shown in FIG. 7, the above-described accommodating recess 68 is formed in an end portion of a bottom surface of the casing 65. The accommodating recess 68 is provided by a recessed portion of a bottom wall 69 of the casing 65. The accommodating recess 68 has a predetermined width W as measured in the width direction of the main body 10, and is elongated in the depth direction of the main body 10. In the accommodating recess 68, the support stand 90 and the load adjuster member 100 are arranged in the width direction of the recess 68, as shown in FIG. 11. When the FBS unit 3 is closed relative to the printer unit 2, as shown in FIG. 1, the support stand 90 lies down and is accommodated in the accommodating recess 68.

The above-described harness outlet 86A and cable outlet 86B are provided in a rear left end portion and a rear right end portion of the bottom surface of the casing 65, respectively, as shown in FIG. 7. As described above, the wire harness 89A and the flat cable 89B extend out of the FBS unit 3 via the harness outlet 86A and the cable outlet 86B, respectively. Each of the harness outlet 86A and the cable outlet 86B is located near a corresponding one of the above-described pivot shaft receivers 63, which receive the respective pivot shafts 73 of the printer unit 2, for connecting the FBS unit 3 to the printer unit 2. The pivot shafts 73 are fitted in the respective pivot shaft receivers 63, whereby the FBS unit 3 pivotably connected to the printer unit 2.

As shown in FIG. 8, the proximal end portion of the support stand 90 is pivotably connected to an upper surface of the printer unit 2. The above-described pivot boss 98 provided in the proximal end portion of the support stand 90 is connected to the above-described pivot-boss receiving portion 130 that is provided in the upper portion of the printer unit 2. The pivot-boss receiving portion 130 is formed integrally with the cover body 8 that coves the printer unit 1 (see FIGS. 9 and 10). A pivot-boss receiver hole 131 is formed in the pivot-boss receiving portion 130, so that the pivot boss 98 provided in the proximal end portion of the support stand 90 is received in the pivot-boss receiver hole 131. In vicinity of the pivot-boss receiving portion 130, a receiving portion 79 is provided to receive or accommodate therein a supporting portion 155 of the cover member 150. In a bottom wall 79B (see FIG. 10) of the receiving portion 79, a cantilever beam 74 is provided in vicinity of the pivot-boss receiving portion 130. The cantilever beam 74 is provided by an elongated resin spring that extends from a side wall 79A (see FIG. 10) of the receiving portion 79 toward the pivot-boss receiving portion 130, and includes a deflection portion 74A and a distal end portion 74B that extends from the deflection portion 74A toward the pivot-boss receiving portion 130 in an oblique upward direction. As shown in FIG. 10, the distal end portion 74B of the cantilever beam 74 is spaced from an inside face 130A of the pivot-boss receiving portion 130 by a distance C1. This distance C1 is slightly larger than a distance C2, which is a distance between the inside face 130A of the pivot-boss receiving portion 130 and the right-side surface 99B of the pivot boss 99 when the pivot boss 98 is received in the pivot-boss receiving portion 130.

As described above, in the upper surface of the printer unit 2, the accommodating portions 70A, 70B are provided for accommodating therein the harness cable 89A and the flat cable 89B, respectively.

Figure 9:
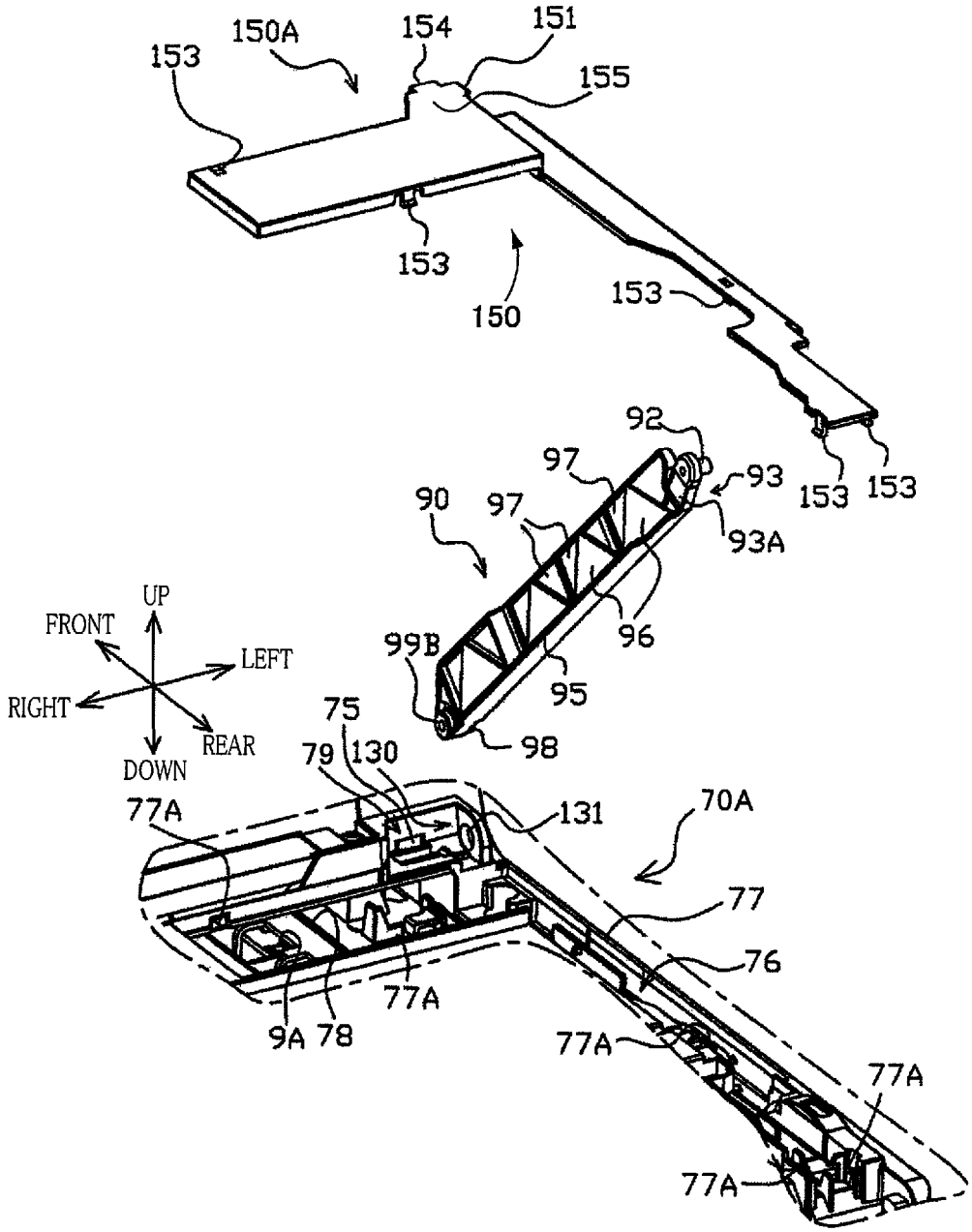
FIG. 9 is an exploded view of the support stand and a part of the printer unit.
Figure 10:
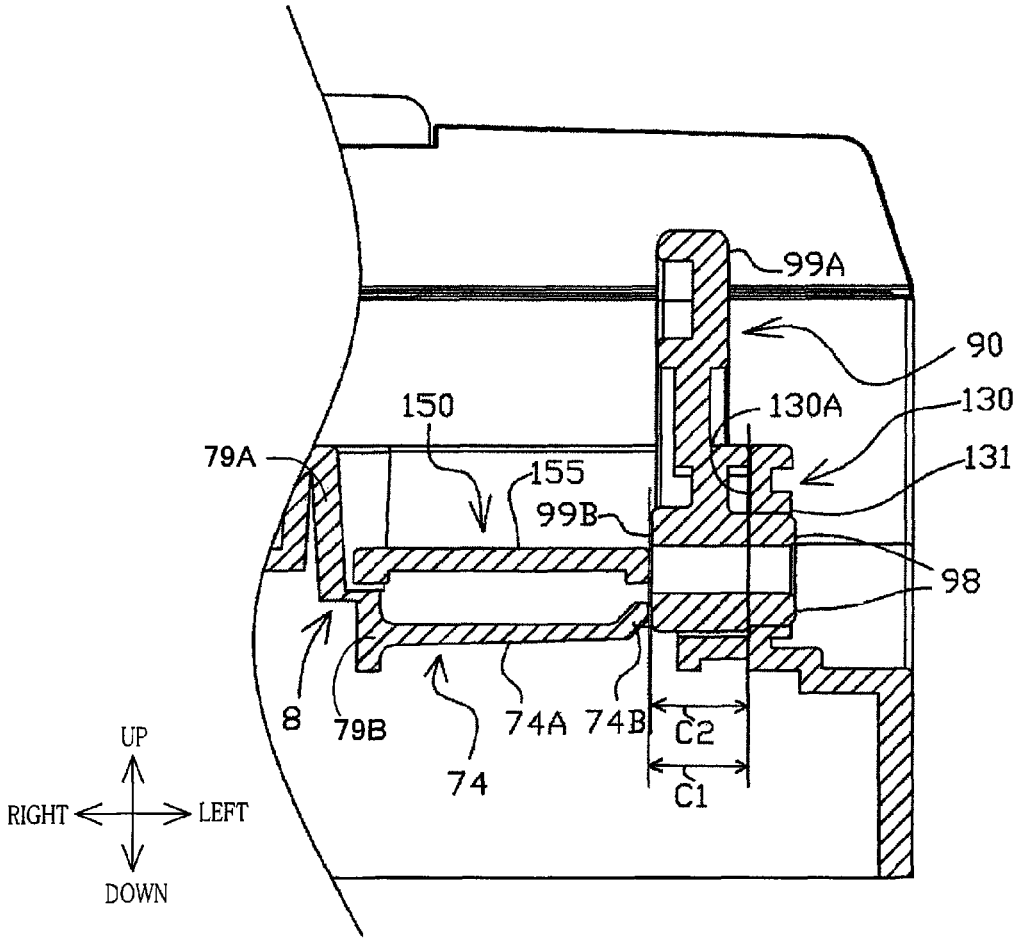
FIG. 10 is a part of a cross sectional view taken along line X-X of FIG. 8.

Referring next to FIGS. 8-10, the accommodating portion 70A will be described in detail. It is noted that the accommodating portion 70B is similar to the accommodating portion 70A with respect to construction and that description of the accommodating portion 70B is omitted since the present invention does not particularly relate to the accommodating portion 70B.

In the present embodiment, the accommodating portion 70A has a generally letter-L shape in its plan view, and is arranged such that a bent portion of the L-shaped accommodating portion 70A is located in vicinity of the pivot-boss receiving portion 130. The accommodating portion 70A has an accommodating recess 76, an opening portion 77 and an opening 78. The accommodating recess 76 extends along a left end portion of the cover body 8, from the pivot-boss receiving portion 130 to a left one of the pair of pivot shafts 73 (see FIG. 8). Although not being illustrated in FIG. 9, the accommodating recess 76 accommodates therein the wire harness 89A. The opening 78 is contiguous to the accommodating recess 76, and extends rightward from the pivot-boss receiving portion 130, so that the connector portion 9A of the control circuit board 9 is exposed through the opening 78. The opening portion 77 is contiguous to the accommodating recess 76 and the opening 78. The above-described cover member 150 is attached to the opening portion 77, whereby the accommodating recess 76 and the opening 78 are closed.

The cover member 150 serves to close the opening portion 77 of the accommodating portion 70A, and is provided by a thin-plate member having substantially the same shape as the opening portion 77 of the accommodating portion 70A in the plan view. In the present embodiment, the cover member 150 has a generally letter L shape. A main portion 150A of the cover member 150 has engaged tabs 153 that are arranged in respective positions corresponding to positions of engaging portions 77A that are provided in the opening portion 77 of the accommodating portion 70A. The main portion 150A of the cover member 150 is integrally formed with the above-described supporting portion 155 that protrudes in the forward direction of the main body 10. The supporting portion 155 has substantially the same shape as the above-described receiving portion 79 provided in the cover body 8 that covers the printer unit 2 (see FIG. 9), so that the supporting portion 155 can be received in the receiving portion 79. The supporting portion 155 includes a contact portion 151 and an engaged protrusion 154. The contact portion 151 is provided to be held in contact with the right-side surface 99B of the proximal end portion of the support stand 90, so as to prevent the support stand 90 from being removed from the pivot-boss receiving portion 130. The engaged protrusion 154 is positioned in a position that is to be aligned with a protrusion receiving aperture 75 that is provided in the receiving portion 79.

Referring next to FIGS. 5-10, there will be described a process of attaching the support stand 90 to the cover body 8 that covers the printer unit 2. It is noted that, in the present embodiment, the support stand 90 is attached to the cover body 8 after the support stand 90 has been attached to the FBS unit 3.

The attaching process is initiated with a step of fitting the pair of pivot shaft receivers 63 (provided in the casing 65 of the FBS unit 3) onto the respective pivot shafts 73 (provided in the printer unit 2) (see FIGS. 7 and 8), for thereby causing the casing 65 of the FBS unit 3 to be pivotably connected to the printer unit 2. In this instance, the wire harness 89A and the flat cable 89B extending out of the FBS unit 3 via the harness outlet 86A and the cable outlet 86B, respectively, are disposed between the casing 65 of the FBS unit 3 and the cover body 8 of the printer unit 2.

Next, the wire harness 89A is accommodated into the accommodating recess 76 of the accommodating portion 70A, and an end portion of the wire harness 89A is introduced into the opening 78 so as to be connected to the connector portion 9A of the control circuit board 9 (see FIG. 9). Then, the pivot boss 98 of the support stand 90 is inserted into the pivot-boss receiver hole 131 of the pivot-boss receiving portion 130 that is formed integrally with the cover body 8, by moving the pivot boss 98 into the pivot-boss receiver hole 131 from the side of the inside face 130A of the pivot-boss receiving portion 130 (see FIGS. 9 and 10). In this instance, the deflection portion 74A of the cantilever beam 74 is elastically deformed, as the pivot boss 98 is moved toward the pivot-boss receiving portion 130 while being in contact with the distal end portion 74B of the cantilever beam 74. When the pivot boss 98 is further moved to be completely inserted into the pivot-boss receiver hole 131, the pivot boss 98 passes over the distal end portion 74B whereby the elastic deformation of the deflection portion 74A is released. Thus, the deflection portion 74A restores its shape from the elastic deformation whereby the distal end portion 74B is positioned to be opposed to the right-side surface 99B of the proximal end portion of the support stand 90, for thereby preventing the pivot boss 98 from being removed from the pivot-boss receiver hole 131. It is noted that the operation for the connection of the end portion of the wire harness 89A to the connector portion 9A of the control circuit board 9 may be carried out either before or after the operation for the connection of the pivot boss 98 to the pivot-boss receiver hole 131 of the pivot-boss receiving portion 130. Where the wire harness 89A is connected to the control circuit board 9 after the pivot boss 98 has been connected to the pivot-boss receiver hole 131, an operator can connect the wire harness 89A to the control circuit board 9 with safety, since the pivot boss 98 is prevented from being removed from the pivot-boss receiver hole 131, owing the provision of the cantilever beam 74.

Next, the cover member 150 is attached to the opening portion 77 of the accommodating portion 70A. For attaching the cover member 150 to the opening portion 77, the engaging protrusion 154 of the supporting portion 155 of the cover member 150 is first introduced into the protrusion receiving aperture 75 of the receiving portion 79 (see FIG. 9), and then the engaging tabs 153 are brought into the respective engaging portions 77A. In this instance, the supporting portion 155 is received into the receiving portion 79, with the contact portion 151 being brought into contact with the right-side surface 99B of the proximal end portion of the support stand 90. The pivot boss 98 of the support stand 90 is thus received into the pivot-boss receiver hole 131 of the pivot-boss receiving portion 130, whereby the support stand 90 is pivotably connected to the printer unit 2. Since the contact portion 151 of the supporting portion 155 is held in contact with the right-side surface 99B of the proximal end portion of the support stand 90, the pivot boss 98 is prevented from being removed from the pivot-boss receiver hole 131.

With the cover member 150 being attached to the opening portion 77 of the accommodating portion 70A, the supporting portion 155 is received in the receiving portion 79 so as to be positioned in vicinity of the side wall 79A. That is, a rightward movement of the supporting portion 155 is limited by the side wall 79A (see FIG. 10), with which the supporting portion 155 is brought into contact when the supporting portion 155 is moved rightwardly. Therefore, even if the support stand 90 is moved rightwardly, i.e., in a direction away from the pivot-boss receiving portion 130 during pivot movement of the FBS unit 3 relative to the printer unit 2, the right movement of the support stand 90 is inhibited by the contact portion 151 of the supporting portion 155, since the support stand 90 is brought into contact with the contact portion 151. That is, it is possible to reliably prevent removal of the support stand 90 from the pivot-boss receiving portion 130. Further, since the engaging protrusion 154 of the supporting portion 155 is introduced in the protrusion receiving aperture 75 of the receiving portion 79, a vertical position of the supporting portion 150 is fixed, namely, a vertical displacement of the supporting portion 150 relative to the receiving portion 79 is prevented. It is therefore possible to prevent removal of the cover member 150 even in a case where the support stand 90 is tilted in a rightward or leftward direction of the main body 10, namely, even in a case where the cover member 150 is forced by the support stand 90 in an upward or downward direction of the main body 10.

Further, owing to the provisions of the engaging protrusion 154 and the protrusion receiving aperture 75, the operation for attaching the cover member 150 to the opening portion 77 is facilitated. Described specifically, with the engaging protrusion 154 being received in the protrusion receiving aperture 75, the cover member 150 can be positioned substantially accurately relative to the opening portion 77 in the width and depth directions of the main body 10. Therefore, the cover member 150 can be easily attached to the opening portion 77, simply with the cover member 150 being pressed down onto the opening portion 77 while the cover member 150 is being received in the protrusion receiving aperture 75.

As described above, the opening portion 77 of the accommodating portion 70A in which the wire harness 89A is accommodated, is covered by the cover member 150. Therefore, it is possible to reliably prevent the wire harness 89A from being erroneously touched by the operator during a maintenance work such as removal of recording sheets jammed inside the printer unit 2.

The pivot-boss receiving portion 130 is formed integrally with the cover body 8 that covers the printer unit 2, while the cover member 150 covers the accommodating portion 70A in which the wire harness 89A is accommodated. These arrangements advantageously eliminate necessity of providing a member serving exclusively to maintain the connection of the support stand 90 with the pivot-boss receiving portion 130, thereby making it possible to save a space required for provision of such an exclusive member and accordingly to reduce a space required for installation of the multifunction device 1.

Further, also when a maintenance work is carried out with the main portion 150A of the cover member 150 being removed, the pivot boss 98 is prevented from being removed from the pivot-boss receiver hole 131 since the distal end portion 74B of the cantilever beam 74 (formed integrally with the cover body 8 covering the printer unit 2) is positioned to be opposed to the right-side surface 99B of the proximal end portion of the support stand 90 (see FIG. 10). Therefore, the FBS unit 3 is prevented from being rapidly pivoted relative to the printer unit 2 in its closing direction. It is therefore possible to prevent a hand of an operator from being caught between the FBS unit 3 and the printer unit 2. The prevention of rapid pivot movement of the FBS unit 3 toward the printer unit 2 leads to prevention of application of large impact to each of the units 2, 3 as electronic devices, which could be damaged or fail in the event of application of large impact thereto.

Further, also in a case where the operation for the connection of the end portion of the wire harness 89A to the connector portion 9A of the control circuit board 9 is carried out after the operation for the connection of the pivot boss 98 to the pivot-boss receiver hole 131 of the pivot-boss receiving portion 130, the pivot boss 98 is prevented from being removed from the pivot-boss receiver hole 131 since the distal end portion 74B of the cantilever beam 74 is positioned to be opposed to the right-side surface 99B of the proximal end portion of the support stand 90. Therefore, during the operation for the connection of the wire harness 89A to the control circuit board 9, the FBS unit 3 is prevented from being abruptly pivoted relative to the printer unit 2 in its closing direction. It is therefore possible to prevent a hand of an operator from being caught between the FBS unit 3 and the printer unit 2.

Further, the cover member 150 can be easily attached to the opening portion 77, simply with the cover member 150 being pressed down onto the opening portion 77 while the cover member 150 is being received in the protrusion receiving aperture 75, as described above, so that it is possible to carry out an operation for assuring the attachment of the support stand 90 to the pivot-boss receiving portion 130, concurrently with the operation for attaching the cover member 150 to the opening portion 77. Further, the attachment of the cover member 150 to the opening portion 77 does not require any fastener such as screw, thereby eliminating necessity of use of a tool and accordingly permitting the multifunction device 1 to be manufactured in a simplified process with high efficiency.

Further, since the supporting portion 155 is received in the receiving portion 79 so as to be positioned in vicinity of the side wall 79A, as described above, the contact of the supporting portion 155 with the side wall 79A prevents removal of the support stand 90 from the pivot-boss receiving portion 130 even in a case where the support stand 90 is tilted in the rightward or leftward direction of the main body 10. Therefore, the FBS unit 3 is prevented from being abruptly pivoted relative to the printer unit 2 in its closing direction. It is therefore possible to prevent a hand of an operator from being caught between the FBS unit 3 and the printer unit 2, for example, during a maintenance work such as removal of recording sheets jammed inside the printer unit 2. The prevention of rapid pivot movement of the FBS unit 3 toward the printer unit 2 leads to prevention of application of large impact to each of the units 2, 3 as electronic devices, which could be damaged or fail in the event of application of large impact thereto.

Further, the vertical position of the supporting portion 150 is fixed by the introduction of the engaging protrusion 154 of the supporting portion 155 in the protrusion receiving aperture 75 of the receiving portion 79. It is therefore possible to prevent removal of the cover member 150 even in a case where the cover member 150 is forced by the support stand 90 in the upward or downward direction of the main body 10. The reliable prevention of the removal of the support stand 90 from the pivot-boss receiving portion 130 provides advantages as described above.

There will be described construction of the distal end portion 94 of the support stand 90. FIG. 11 is a cross sectional view showing an inside of the accommodating recess 68, taken in a plane perpendicular to the depth direction of the main body 10. The distal end portion 94 of the support stand 90 includes the engaged pin 92 that protrudes in the leftward direction of the main body 10. The engaged pin 92 has a circular cross section and a diameter D as shown in FIG. 11. The engaged pin 92 is engaged in the guide groove 103 of the load adjuster member 100. The distal end portion 94 further includes a gripped portion in the form of a wedge-shaped portion 93 that is located in vicinity of the engaged pin 92. As shown in FIG. 11, the wedge-shaped portion 93 has a thickness (as measured in the thickness direction of the support stand 90) that is increased in a direction away from the distal end portion 94 toward the proximal end portion of the support stand. The wedge-shaped portion 93 having a wedge-like shape includes a peripheral portion that is provided by a high friction member 93A as a high friction portion. The high friction member 93A has a minimum thickness A1 and a maximum thickness A2 (A1<A2). The high friction member 93A is made of a rubber or other material having a high coefficient of friction, and is provided to generate a large frictional force during sliding movement of the distal end portion 94 in the accommodating recess 68. That is, the support stand 90 is provided by at least two portions including the high friction portion that has a higher coefficient of friction than the other of the at least two portions. The high friction member 93A as the high friction portion is bonded to the other portion or portions of the support stand 90 by suitable means such as adhesive. In the present embodiment, the high friction member 93A provides an entirety of the peripheral portion of the wedge-shaped portion 93 (that includes opposite side portions of the wedge-shaped portion 93). However, the high friction member 93A may provide at least one of the opposite side portions of the wedge-shaped portion 93.

Figure 12:
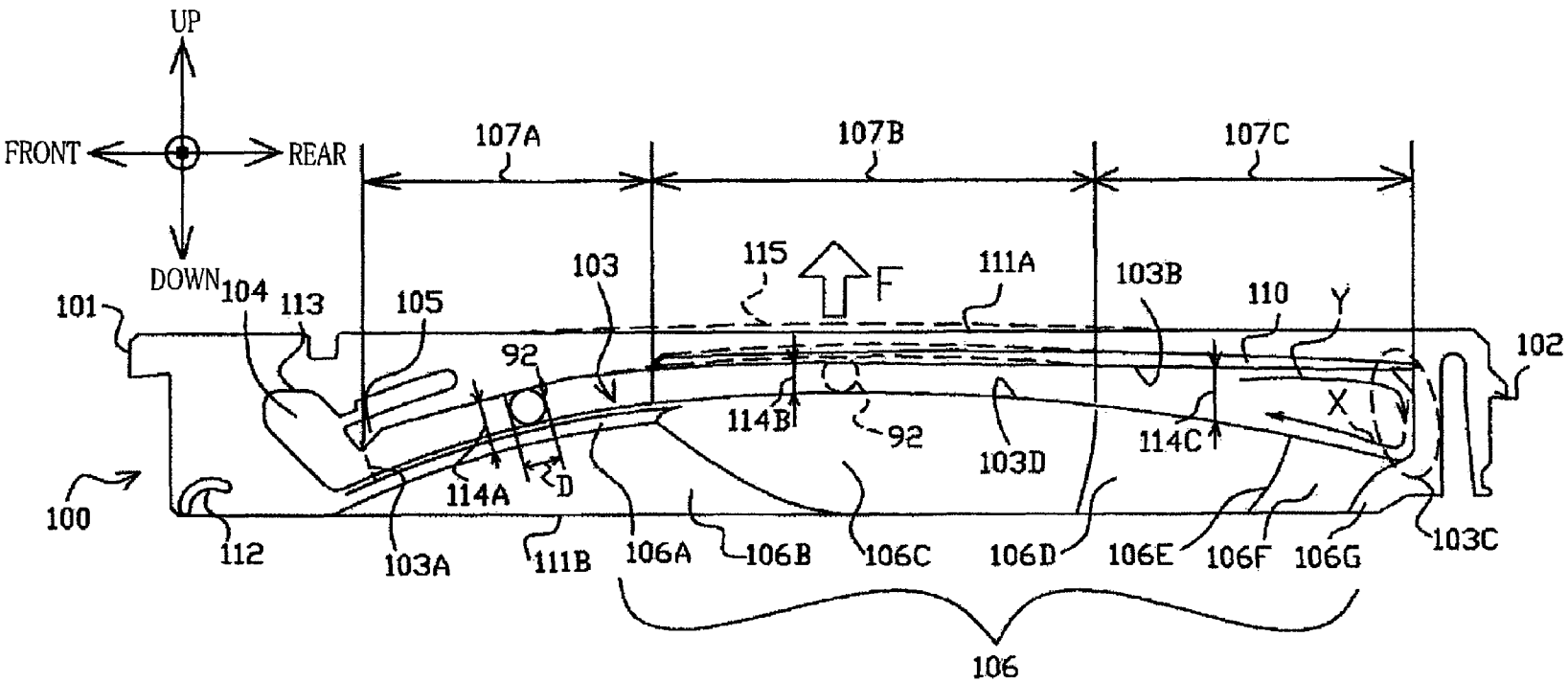
FIG. 12 is a view of the load adjuster member having the guide groove for guiding a distal end portion of the support stand.
Figure 13:
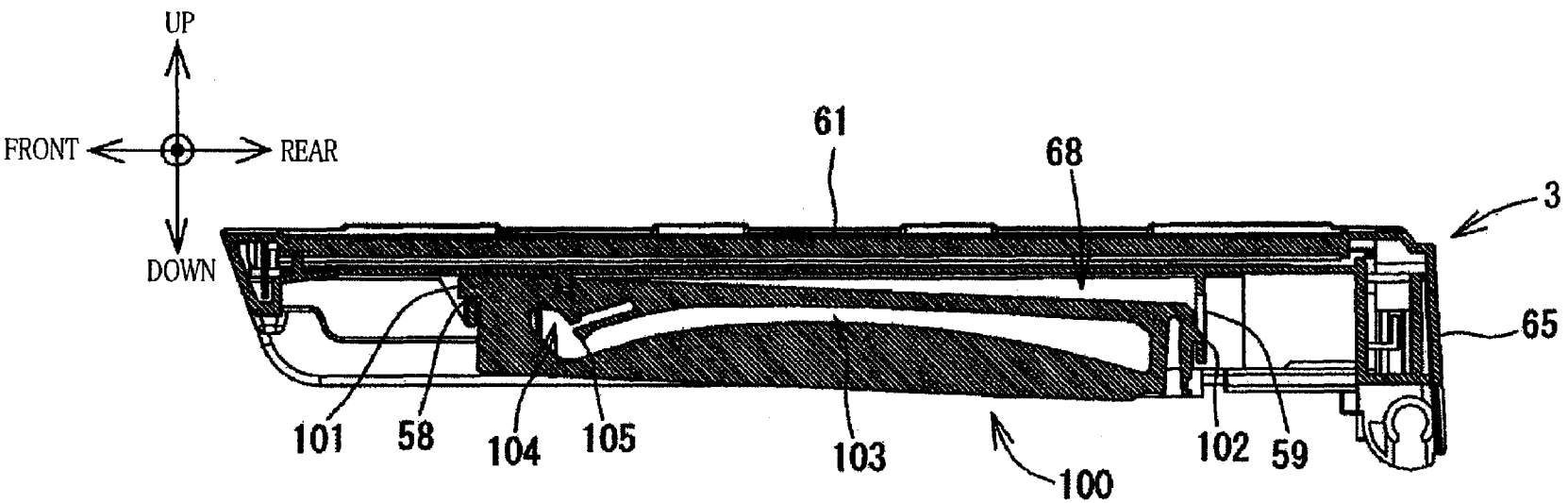
FIG. 13 is a cross sectional view showing a position of the load adjuster member relative to the accommodating recess when the load adjuster member is placed in its non-fully gripping position.
Figure 14:
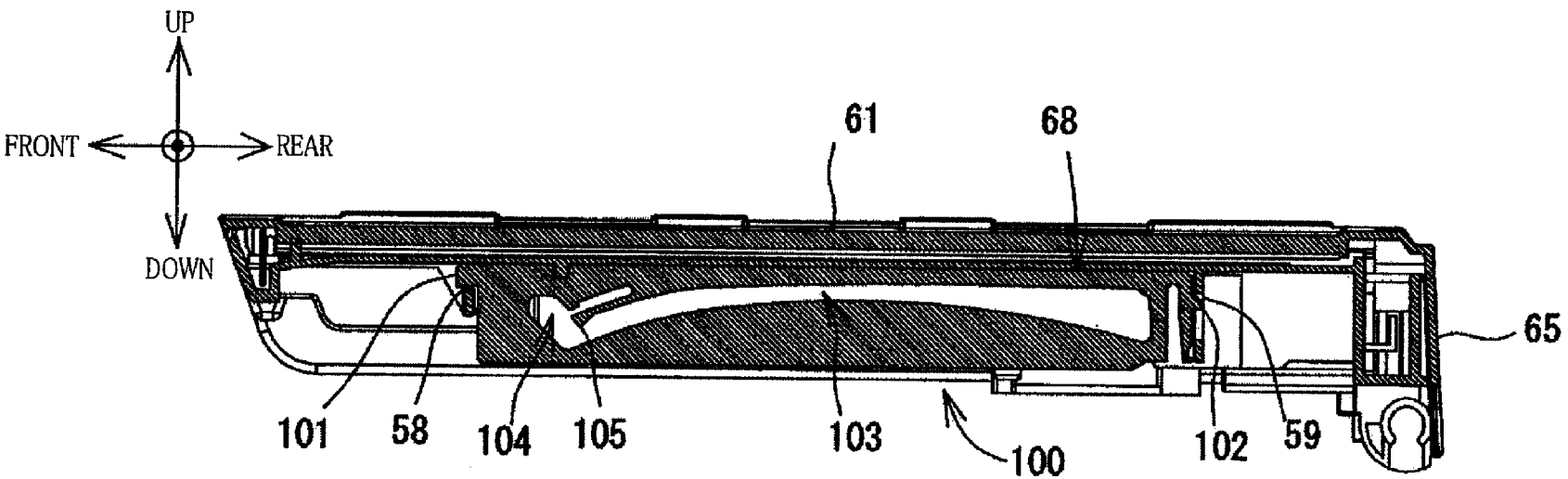
FIG. 14 is a cross sectional view showing a position of the load adjuster member relative to the accommodating recess when the load adjuster member is placed in its fully gripping position.

Referring next to FIGS. 11, 12, 13, 14, 15A, 15B, 16A and 16B, there will be described construction of the load adjuster member 100 as the grooved member. FIG. 12 is an elevational view of the load adjuster member 100 accommodated in the accommodating recess 68 and having the guide groove 103 for guiding the distal end portion 94 of the support stand 90. In FIG. 12, there are indicated the upper, lower front and rear directions of the main body 10 in a state in which the support stand 90 is in a horizontal posture that allows the printer unit 2 to be placed in its closed position relative to the FBS unit 3. FIG. 13 is a cross sectional view showing a position of the load adjuster member 100 relative to the accommodating recess 68 when the load adjuster member 100 is placed in its non-fully gripping position. FIG. 14 is a cross sectional view showing a position of the load adjuster member 100 relative to the accommodating recess 68 when the load adjuster member is placed in its fully gripping position. It is noted that each of the cross sectional views of FIGS. 13 and 14 is taken on a plane perpendicular to the width direction of the main body 10.

The load adjuster member 100 is provided by a generally flat plate-like member that is made of a synthetic resin, for example, and is attached to the casing 65 of the FBS unit 3 such that a longitudinal direction, a width direction and a thickness direction of the load adjuster member 100 correspond to the depth direction, the vertical direction and the width direction of the main body 10, respectively. The load adjuster member 100 has first and second engaged protrusions 101, 102 that are located in one and other of its longitudinally opposite end portions. The load adjuster member 100 is fixedly accommodated in the accommodating recess 68 through the first and second engaged protrusions 101, 102 that are held in engagement with first and second engaging holes 58, 59, respectively. The first and second engaging holes 58, 59 are provided in a bottom 68A of the accommodating recess 68, as shown in FIG. 7, so as to be spaced apart from the depth direction of the main boy 10 by a distance corresponding to a length of the load adjuster member 100. The first engaged protrusion 101 is inserted in the first engaging hole 58, and is positioned in a position that is not substantially displaced relative to the accommodating recess 68 in a depth direction of the accommodating recess 68. The second engaged protrusion 102 is inserted in the second engaging hole 59 that is an elongated hole elongated in the depth direction of the accommodating recess 68, and is positioned in a position that is displaceable relative to the accommodating recess 68 in the depth direction of the accommodating recess 68, as shown in FIGS. 13 and 14. Therefore, the load adjuster member 100 is pivotable about the first engaged protrusion 101, and the second engaged protrusion 102 is displaceable within the second engaging hole 59 in the depth direction of the accommodating recess 68. By the displacement of the load adjuster member 100 relative to the accommodating recess 68, the load adjuster member 100 can be selectively placed in its fully gripping position and its non-fully gripping position. When being placed in its fully gripping position, the load adjuster member 100 is accommodated substantially in its entirety within the accommodating recess 68. When being placed in its non-fully gripping position, the load adjuster member 100 partially protrudes out from the accommodating recess 68. The part of the load adjuster member 100, which protrudes from the recess 68 during placement of the load adjuster member 100 in the non-fully gripping position, includes a pressing contact portion 106 (see FIG. 12).

As shown in FIG. 12, the load adjuster member 100 is elongated in a direction in which the distal end portion of the support stand 90 is slidable relative to the FBS unit 3. The load adjuster member 100 has a thickness B1 as measured in the width direction of the main body 10 (see FIG. 11). The guide groove 103 formed through the load adjuster member 100 has the upwardly convex arcuate shape, and is extends in the above-described direction in which the distal end portion of the support stand 90 is sidable relative to the FBS unit 3. The engaged portion 92 as the engaged portion of the distal end portion 94 of the support stand 90 is engaged in the guide groove 103 (see FIG. 11).

The engaged pin 92 is slidable along the guide groove 103 and an engaged end groove 104 which is formed to be contiguous to the guide groove 103 and which is located in the distant portion of the FBS unit 3. During an opening transition from the closed position of the FBS unit 3 (as shown in FIG. 1) to the open position of the FBS unit 3 (as shown in FIG. 3), the distal end portion 94 is slid in a direction away from the above-describe connected portion of the FBS unit 3 toward the above-described distant portion of the FBS unit 3.

The guide groove 103 has a front end 103A, an upper end 103B, a rear end 103C and a lower end 103D, as shown in FIG. 12. The upper, lower and rear ends 103B, 103D, 103C are defined by respective curved lines that are contiguous to each other. The front end 103A is defined by an opening end at which the engaged end groove 104 is contiguous to the guide groove 103 and from which the engaged end groove 104 extends in an upwardly forward direction of the main body 10.

When the engaged pin 92 is introduced into the engaged end groove 104 from the guide groove 103 and is then held in contact with an engaged end 113 (see FIG. 12), the support stand 90 is held in a vertical posture for maintaining the open portion of the FBS unit 3 relative to the printer unit 2. The load adjuster member 100 has, in its front end portion, a supported portion 112 (see FIG. 12) that is to be brought into contact with the above-described supporting portion 91 of the distal end portion 94 of the support stand 90. That is, the vertical posture of the support stand 90 can be reliably maintained, owing to the contact of the engaged pin 92 with the engaged end 113 and also the contact of the supporting portion 91 with the supported portion 112.

In a boundary between the guide groove 103 and the engaged end groove 104, there is provided a deformable protrusion 105 that is elastically deformable in a direction that increases a width of the guide groove 103. The deformable protrusion 105 has to be elastically deformed for allowing the engaged pin 92 (that has been once introduced into the engaged end groove 104) to return to the guide groove 103. Owing to this arrangement, when the FBS unit 3 is closed relative to the printer unit 2, the engaged pin 92 returning from the engaged end groove 104 to the guide groove 103 causes the deformable protrusion 105 to be elastically deformed, thereby enabling the operator to recognize displacement of the engaged pin 92 from the engaged end groove 104 to the guide groove 103.

The guide groove 103 is sectioned into an opening side region 107A, an intermediate region 107B and a closing side region 107C that are different from each other with respect to a positional relationship between the upper and lower ends 103B, 103D therein.

In the opening side region 107A of the guide groove 103, the upper and lower ends 103B, 103D are substantially parallel to each other (see FIG. 12), and a distance 114A between the upper and lower ends 103B, 103D is slightly larger than the diameter D of the engaged pin 92 (114A>D) (see FIG. 11). Therefore, during sliding movement of the engaged pin 92 in the opening side region 107A, the engaged pin 92 is smoothly moved along the guide groove 103.

In the intermediate region 107B of the guide groove 103, the upper end 103B is defined by an arc that is larger than an arc defining the lower end 103D, and a distance 114B between the upper and lower ends 103B, 103D is smaller than the above-described distance 114A in the opening side region 107A (see FIG. 12). Further, in the intermediate region 107B, the distance 114B is smaller than the diameter D of the engaged pin 92 (114B<D) (see FIGS. 15A and 15B). Therefore, during sliding movement of the engaged pin 92 in the intermediate region 107B, the width of the guide groove 103 is increased by the engaged pin 92 that is slid along the guide groove 103. That is, an upper surface 111A of the load adjuster member 100 is elastically deformed in the upward direction as indicated by arrow F in FIG. 12, whereby the load adjuster member 100 has a deformed posture.

In the closing side region 107C of the guide groove 103, the upper end 103B is defined by a substantially straight line such that a distance 114C between the upper and lower ends 103B, 103D is gradually reduced as viewed in a direction away from a boundary of the intermediate region 107B and the closing side region 107C toward the rear end 103C of the guide groove 103 (see FIG. 12). Further, in the closing side region 107C, a distance 114C is larger than the diameter D of the engaged pin 92 (114C>D) (see FIGS. 16A and 16B).

The load adjuster member 100 has an elongated protrusion portion 110 which is provided on its right side surface facing the support stand 90 and which protrudes toward the support stand 90 (see FIGS. 12, 15A, 15B, 16A and 16B). The elongated protrusion portion 110 is located in a portion of the load adjuster member 100 that defines the intermediate region 107B and the closing side region 107C of the guide groove 103, and extends along the upper side 103B of the guide groove 103. The load adjuster member 100 further has the above-described pressing contact portion 106 which is provided also on its right side surface.

The pressing contact portion 106 includes a thickness reduction portion 106A, a flat thin-walled portion 106B, a first uphill portion 106C, a second uphill portion 106D, a crest portion 106E, a downhill portion 106F and a foot portion 106 (see FIG. 12). The thickness reduction portion 106A is located in an opening side portion of the load adjuster member 100 that defines the opening side region 107A, and is contiguous to the lower end 103D of the guide groove 103. The flat thin-walled portion 106B has a small thickness and is contiguous to the thickness reduction portion 106A. In the opening side portion of the load adjuster member 100, a thickness of the lower end 103D of the guide groove 103 is equal to the thickness B1 of the load adjuster member 100, while a thickness B2 of the flat thin-walled portion 106B is smaller than the thickness B1 of the load adjuster member 100 (see FIG. 11). The thickness reduction portion 106A interconnects between the lower end 103D of the guide groove 103 to the flat thin-walled portion 106B. It is noted that the above-described thickness B1 is defined as a thickness of an upper end portion of the load adjuster member 100 in which neither the above-described elongated protrusion portion 110 nor pressing contact portion 106 is located.

In the portion of the load adjuster member 100 that defines the intermediate region 107B and the closing side region 107C of the guide groove 103, the pressing contact portion 106 has a generally mountain-like shape having slopes that are located on opposite sides of a crest portion 106E.

Described more specifically, the first uphill portion 106C is located in an intermediate portion of the load adjuster member 100 that defines the intermediate region 107B of the guide groove 103. The first uphill portion 106C gradually bulges in the thickness direction of the load adjuster member 100 (more precisely in the rightward direction). The first uphill portion 106C has a thickness B3 (see FIGS. 15A and 15B) that is gradually increased as viewed in a direction away from a boundary of the opening side region 107A and the intermediate region 107B toward a boundary of the intermediate region 107B and the closing side region 107C. The second uphill portion 106D is located in a closing side portion of the load adjuster member 100 that defines the closing side region 107C of the guide groove 103. The second uphill portion 106D is contiguous to the first uphill portion 106C, and bulges in the thickness direction of the load adjuster member 100 (more precisely in the rightward direction) as the first uphill portion 106C. The second uphill portion 106D has a thickness B4 (see FIGS. 16A and 16B) that is gradually increased as viewed in a direction away from the first uphill portion 106C toward the crest portion 106E. The thickness B4 of the second uphill portion 106D is larger than the thickness B3 of the first uphill portion 106C (B4>B3). However, the second uphill portion 106D is sloped more gently than the first uphill portion 106C.

In addition to the second downhill portion 106D and the crest portion 106E, the downhill portion 106F and the foot portion 106G are located in the closing side portion of the load adjuster member 100. In the downhill portion 106F interconnecting the crest portion 106E and the foot portion 106G, the thickness of the load adjuster member 100 is reduced as viewed in a direction away from the crest portion 106E toward the foot portion 106G, so that the bulge is eliminated in the foot portion 106G. The downslope in the downhill portion 106F is steeper than the upslope in each of the first and second uphill portions 106C, 106D. The crest portion 106E has a thickness B5 that is a maximum thickness of the pressing contact portion 106 of the load adjuster member 100. The foot portion 106G has a thickness corresponding to the above-described thickness B1. The downhill portion 106F has a thickness B6 which is reduced as viewed in the direction away from the crest portion 106E toward the foot portion 106G and which is smaller than the thickness B5 of the crest portion 106E and larger than the thickness B1.

In the present embodiment, the pressing contact portion 106 of the load adjuster member 100 serves as a first contact portion, while a right-side inner wall 66 (see FIGS. 11, 15A, 15B, 16A and 16B) of the accommodating recess 68 serves as a second contact portion that is opposed to the first contact portion in an opposed direction. As is clear from the above description, a distance between the pressing contact portion 106 and the right-side inner wall 66 (as measured in the opposed direction) is gradually reduced as seen in a direction away from the front portion (distant portion) of the FBS unit 3 toward the rear portion (connected portion) of the FBS unit 3, at least in the first and second uphill portions 106C, 106D.

Further, as shown in FIGS. 15A, 15B, 16A and 16B, the thickness of the pressing contact portion 106 of the load adjuster member 100 is reduced as seen in a direction away from the upper surface 111A of the load adjuster member 100 toward a lower surface 111B of the load adjuster member 100, at least in the first and second uphill portions 106C, 106D and the downhill portion 106F. In other words, the distance between the pressing contact portion 106 and the right-side inner wall 66 (as measured in the opposed direction) is gradually reduced as seen in a direction away from a contactable one of opposite side surfaces of the FBS unit 3 (at which the FBS unit 3 is brought into contact with the printer unit 2 when the FBS unit 3 is placed in its closed position) toward the other of the opposite side surfaces of the FBS unit 3.

As described above, while being placed in its fully gripping position, the load adjuster member 100 is accommodated substantially in its entirety within the accommodating recess 68 (see FIG. 14). That is, during placement of the load adjuster member 100 in the fully gripping position, the pressing contact portion 106 of the load adjuster member 100 is positioned to be opposed to the right-side inner wall 66 of the accommodating recess 68, with the distal end portion 94 of the support stand 90 being interposed between the pressing contact portion 106 and the right-side inner wall 66, namely, with the wedge-shaped portion 93 of the distal end portion 94 being wedged into between the pressing contact portion 106 of the load adjuster member 100 and the right-side inner wall 66 of the accommodating recess 68. Therefore, when the engaged pin 92 of the distal end portion 94 of the support stand 90 is slid along the guide groove 103 during the placement of the load adjuster member 100 in the fully gripping position, a frictional force is generated due to the sliding contact of the wedge-shaped portion 93 with the pressing contact portion 106 and the right-side inner wall 66 (see FIGS. 15A and 16A). In this instance, an amount of the generated frictional force is changed depending on the thickness of the pressing contact portion 106 that is not constant as described above.

On the other hand, while the load adjuster member 100 is placed in its non-fully gripping position, the part (including the pressing contact portion 106) of the load adjuster member 100 protrudes out from the accommodating recess 68 (see FIG. 13). That is, during placement of the load adjuster member 100 in the non-fully gripping position, the wedge-shaped portion 93 of the distal end portion 94 is wedged into between the pressing contact portion 106 of the load adjuster member 100 and the right-side inner wall 66 of the accommodating recess 68, by an extent smaller than during placement of the load adjuster member 100 in the fully gripping position (see FIGS. 15B and 16B). Therefore, when the engaged pin 92 of the distal end portion 94 of the support stand 90 is slid along the guide groove 103 during the placement of the load adjuster member 100 in the non-fully gripping position, the frictional force generated due to the sliding contact is smaller than during placement of the load adjuster member 100 in the fully gripping position. As described above, the elongated protrusion portion 110 is provided to extend along the upper end 103B of the guide groove 103 (see FIGS. 12, 15A, 15B, 16A and 16B). Owing to the provision of the protrusion portion 110 protruding in the same direction as the pressing contact portion 106, the engaged pin 92 of the support stand 90 is prevented from being removed from the guide groove 103, when the engaged pin 92 is forced in a direction away from the guide groove 103.

Referring still to FIGS. 11, 12, 15A, 15B, 16A and 16B, there will be described a dimensional relationship between the width W of the accommodating recess 68, the minimum thickness A1 and the maximum thickness A2 of the wedge-shaped portion 93 of the distal end portion 94 of the support stand 90, the thickness B1 of the upper end portion of the load adjuster member 100 (in which neither the above-described elongated protrusion portion 110 nor pressing contact portion 106 is located), the thickness B2 of the flat thin-walled portion 106B (located in the opening side portion of the load adjuster member 100 that defines the opening side region 107A), the thickness B3 of the first uphill portion 106C (located in the intermediate portion of the load adjuster member 100 that defines the intermediate region 107B) and the thickness B4 of the second uphill portion 106D (located in the closing side portion of the load adjuster member 100 that defines the closing side region 107C). It is noted that each of FIGS. 11, 12, 15A, 15B, 16A and 16B is a cross sectional view taken in a plane that is perpendicular to the depth direction of the main body 10.

In the opening side portion of the load adjuster member 100 that defines the opening side region 107A, the thickness B2 of the flat thin-walled portion 106B is smaller than the thickness B1 of the upper end portion of the load adjuster member 100 (B2<B1) (see FIG. 11). Further, the thickness B2 of the flat thin-walled portion 106B is smaller than a value obtained by subtracting the maximum thickness A2 of the wedge-shaped portion 93 from the width of the accommodating recess 68 (B2<W−A2). Therefore, even while the load adjuster member 100 is being placed in the fully gripping position, the wedge-shaped portion 93 is not brought into pressing contact with the pressing contact portion 106 of the load adjuster member 100 and/or the right-side inner wall 66 of the accommodating recess 68, during sliding movement of the distal end portion 94 of the support stand 90 along the opening side region 107A of the guide groove 103. That is, the distal end portion 94 of the support stand 90 is smoothly slid along the opening side region 107A of the guide groove 103, without large resistance acting against the sliding movement of the distal end portion 94.

As shown in FIG. 12, the thickness reduction portion 106A interconnects the lower end 103D (having the thickness B1) and the flat thin-walled portion 106B (having the thickness B2). The thickness reduction portion 106A and the flat thin-walled portion 106B cooperate with each other to define a V-shaped surface (see FIG. 11). Further, as described above, the wedge-shaped portion 93 including the high friction member 93A has the thickness that is increased in the direction away from the distal end portion 94 of the support stand 90 toward the proximal end portion of the support stand 90. Therefore, even if the support stand 90 is tiled in the rightward or leftward direction of the main body 10, the high friction member 93A of the wedge-shaped portion 93 is not brought into contact at its large area with the lower end 103D and the flat thin-walled portion 106B, so that the distal end portion 94 of the support stand 90 is smoothly slid without a large resistance acting against the sliding movement of the wedge-shaped portion 93.

Figure 15B:
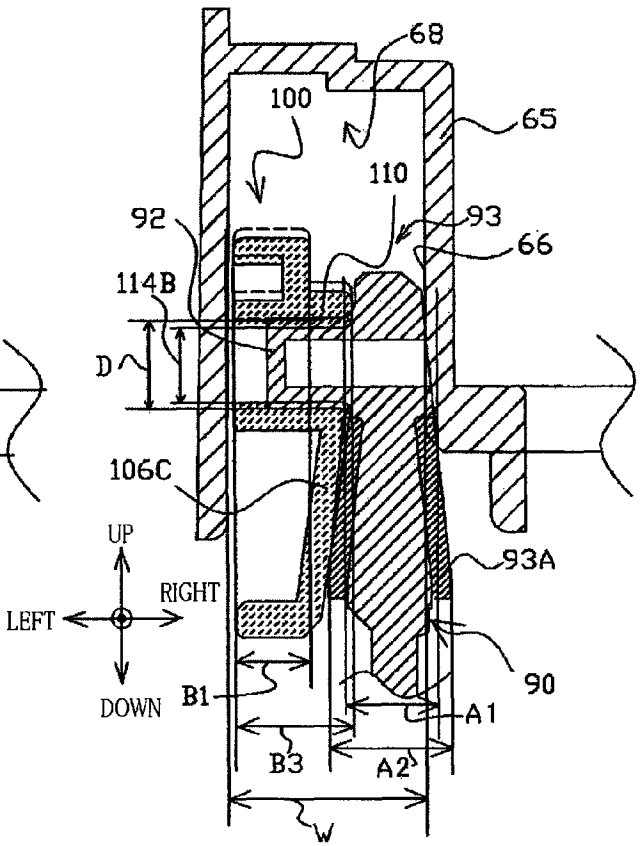
Figure 15A:
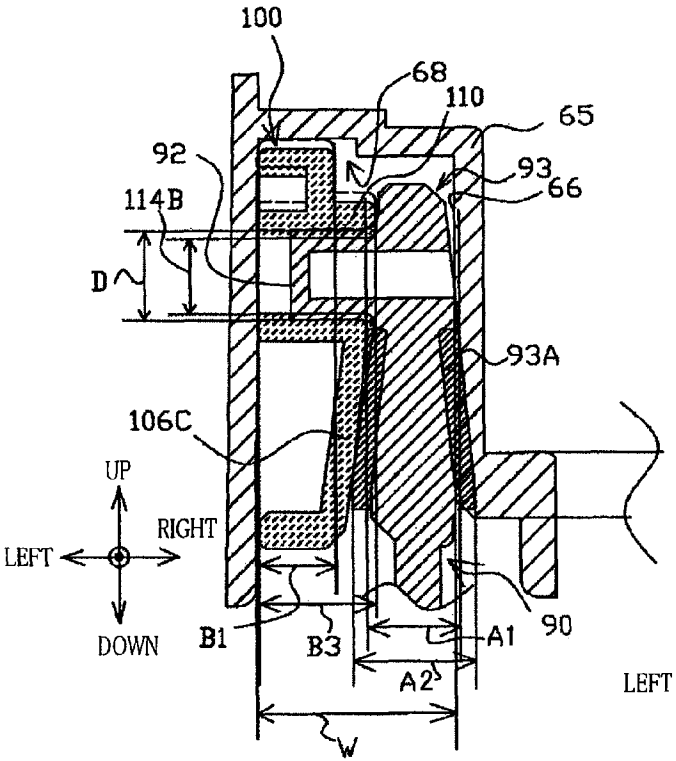

In the intermediate portion of the load adjuster member 100 that defines the intermediate region 107B, the thickness B3 of the first uphill portion 106C is larger than a value obtained by subtracting the minimum thickness A1 of the wedge-shaped portion 93 from the width of the accommodating recess 68 (B3>W−A1) (see FIGS. 15A and 15B). Further, in the closing side portion of the load adjuster member 100 that defines the closing side region 107C, each of the thickness B4 of the second uphill portion 106D, the thickness of the crest portion 106E and the thickness of the downhill portion 106F is larger than a value obtained by subtracting the minimum thickness A1 of the wedge-shaped portion 93 from the width of the accommodating recess 68 (B4>W−A1) (see FIGS. 16A and 16B).

Therefore, while the load adjuster member 100 is being placed in the fully gripping position, the wedge-shaped portion 93 is brought into pressing contact with the pressing contact portion 106 of the load adjuster member 100 and the right-side inner wall 66 of the accommodating recess 68, namely, the wedge-shaped portion 93 is wedged into between the pressing contact portion 106 and the right-side inner wall 66, during sliding movement of the distal end portion 94 of the support stand 90 along the intermediate region 107B and closing side region 107C of the guide groove 103. That is, a frictional force is generated due to the sliding contact of the wedge-shaped portion 93 with the pressing contact portion 106 and the right-side inner wall 66 (see FIGS. 15A and 16A).

Figure 16B:
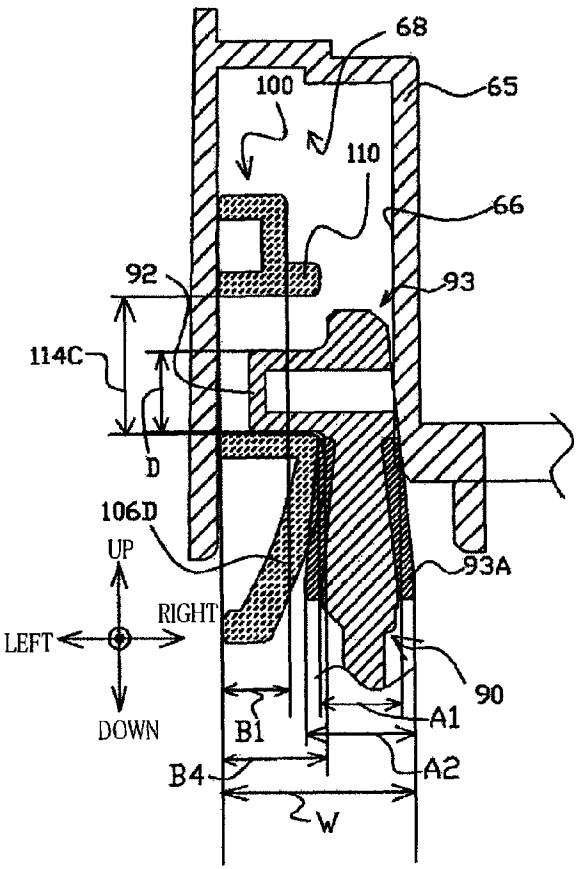

When the load adjuster member 100 is placed in its non-fully gripping position, the part (including the pressing contact portion 106) of the load adjuster member 100 protrudes out from the accommodating recess 68 (see FIGS. 12, 15B and 16B). In this instance, a part of the distal end portion 94 of the support stand 90 also protrudes out from the accommodating recess 68 (see FIGS. 15A and 16B), since the engaged pin 92 is held in engagement with the guide groove 103 of the load adjuster member 100. Described more in detail, a part of the wedge-shaped portion 93 having the maximum thickness A2 is removed from a spaced defined between the mutually opposed surfaces of the accommodating recess 68. In other words, during placement of the load adjuster member 100 in the non-fully gripping position, the wedge-shaped portion 93 of the distal end portion 94 is wedged into between the pressing contact portion 106 of the load adjuster member 100 and the right-side inner wall 66 of the accommodating recess 68, by an extent smaller than during placement of the load adjuster member 100 in the fully gripping position. Therefore, when the engaged pin 92 of the distal end portion 94 of the support stand 90 is slid along the guide groove 103 during the placement of the load adjuster member 100 in the non-fully gripping position, the frictional force generated due to the sliding contact is smaller than during placement of the load adjuster member 100 in the fully gripping position. In this instance, since only a part of the wedge-shaped portion 93 having the minimum thickness A1 is located in the spaced defined between the mutually opposed surfaces of the accommodating recess 68, the wedge-shaped portion 93 is not fully gripped by the pressing contact portion 106C of the load adjuster member 100 and the right-side inner wall 66 of the accommodating recess 68, an excessively large frictional force is not generated by the sliding contact of the wedge-shaped portion 93 with the pressing contact portion 106 and the right-side inner wall 66.

Figure 16A:
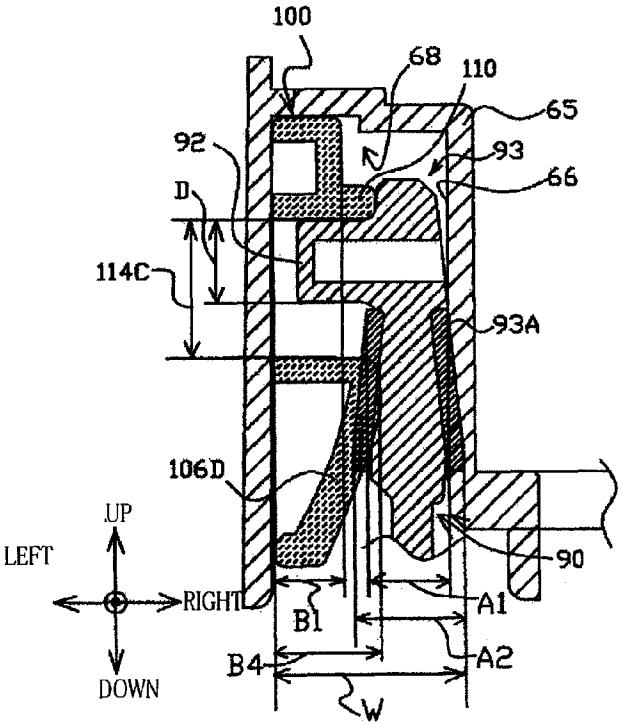

Referring still to FIGS. 11, 12, 15A, 15B, 16A and 16B, there will be described operations of the support stand 90 and the load adjuster member 100 during the opening and closing transitions of the FBS unit 3. FIG. 11 shows a positional relationship between the accommodating recess 68 and the opening side portion of the load adjuster member 100 when the load adjuster member 100 is placed in its fully gripping position. FIG. 15A shows a positional relationship between the accommodating recess 68 and the intermediate portion of the load adjuster member 100 when the load adjuster member 100 is placed in its fully gripping position. FIG. 15B shows a positional relationship between the accommodating recess 68 and the intermediate portion of the load adjuster member 100 when the load adjuster member 100 is placed in its non-fully gripping position. FIG. 16A shows a positional relationship between the accommodating recess 68 and the closing side portion of the load adjuster member 100 when the load adjuster member 100 is placed in its fully gripping position. FIG. 16B shows a positional relationship between the accommodating recess 68 and the closing side portion of the load adjuster member 100 when the load adjuster member 100 is placed in its non-fully gripping position.

The support stand 90 is pivoted about a center of the pivot boss 98 that is provided in the proximal end portion of the support stand 90, when the FBS unit 3 is being opened and closed relative to the printer unit 2. During the pivot movement of the support stand 90, the engaged pin 92 of the distal end portion 94 of the support stand 90 is slid along the guide groove 103 of the load adjuster member 100.

As described above, the load adjuster member 100 is accommodated in the accommodating recess 68 of the casing 65 of the FBS unit 3, and is pivotable about the first engaged protrusion 101 that is provided in the front end portion of the load adjuster member 100. When the load adjuster member 100 is pivoted about the first engaged protrusion 101, the second engaged protrusion 102 provided in the rear end portion of the load adjuster member 100 is displaced within the second engaging hole 59 in the depth direction of the accommodating recess 68. By the displacement of the load adjuster member 100 relative to the accommodating recess 68, the load adjuster member 100 can be selectively placed in its fully gripping position and its non-fully gripping position. As long as any external force is not applied to the load adjuster member 100, the load adjuster member 100 is lowered at its rear end portion due to gravity whereby the load adjuster member 100 is placed in its non-fully gripping position, as shown in FIG. 13, so that the upper surface 111A of the load adjuster member 100 is separated from the bottom 68A of the accommodating recess 68 and the part of the load adjuster member 100 protrudes out from the accommodating recess 68. The part of the load adjuster member 100, which protrudes from the recess 68 during placement of the load adjuster member 100 in the non-fully gripping position, includes the pressing contact portion 106.

On the other hand, when an external force acts on the load adjuster member 100 in the upward direction, the load adjuster member 100 is pivoted in a direction that causes its rear end portion to be upwardly displaced against the gravity whereby the load adjuster member 100 is placed in its fully gripping position, as shown in FIG. 14, so that the upper surface 111A of the load adjuster member 100 is brought into contact with the bottom 68A of the accommodating recess 68. In this instance, the pressing contact portion 106 is also accommodated in the accommodating recess 68.

While the FBS unit 3 is completely open, the engaged pin 92 of the distal end portion 94 of the support stand 90 is held in engagement with the engaged end groove 104. By the engagement of the engaged pin 92 with the engaged end groove 104, the engaged pin 92 is limited from being moved relative to the load adjuster member 100 in the longitudinal direction of the load adjuster member 100 or the guide groove 103, whereby the support stand 90 is held in a vertical posture, as shown in FIG. 3. Thus, the support stand 90 serves as a diagonal brace to maintain the open position of the FBS unit 3 relative to the printer unit 2.

There will be described operations of the support stand 90 and the load adjuster member 100 that are performed during the closing transition of the FBS unit 3 (during which the front portion of the FBS unit 3 is forced in a direction toward the front portion of the printer unit 2).

For placing the FBS unit 3 into the close position (as shown in FIG. 1) from the open position (as shown in FIG. 3), the front portion of the FBS unit 3 is once raised by an operator, for allowing the engaged pin 92 (having been once introduced into the engaged end groove 104) to return to the guide groove 103. Then, the front portion of the FBS unit 3 is pressed down for causing the deformable protrusion 105 to be elastically deformed in the direction that increases the width of the guide groove 103, so as to allow the engaged pin 92 to return to the guide groove 103. By further pressing down the front portion of the FBS unit 3 toward the front portion of the printer unit 2, the engaged pin 92 is downwardly forced through the load adjuster member 100, whereby the support stand 90 is pivoted to its horizontal posture from its vertical posture, and the engaged pin 92 is slid in a direction away from the front portion of the FBS unit 3 toward the rear portion of the FBS unit 3.

In this instance, the engaged pin 92 engaged in the guide groove 103 is forced against the upper end 103B of the guide groove 103, by a reaction opposite to a force which is applied from the load adjuster member 100 to the engaged pin 92 and which downwardly forces the engaged pin 92. That is, when the FBS unit 3 is closed relative to the printer unit 2, the engaged pin 92 is slid while being forced against the upper end 103B of the guide groove 103, whereby the second engaged protrusion 102 of the load adjuster member 100 is moved upwardly within the second engaging hole 59, so that the upper surface 111A of the load adjuster member 100 is forced against the bottom 68A of the accommodating recess 68. That is, when the FBS unit 3 is closed relative to the printer unit 2, the load adjuster member 100 is placed in its fully gripping position whereby the load adjuster member 100 in its entirety including the pressing contact portion 106 is accommodated in the accommodating recess 68. Further, when the FBS unit 3 is closed relative to the printer unit 2, the wedge-shaped portion 93 of the distal end portion 94 of the support stand 90 is forced to be wedged into between the pressing contact portion 106 of the load adjuster member 100 and the right-side inner wall 66 of the accommodating recess 68.

In an initial stage of the closing transition from the open position of the FBS unit 3 to the closed position of the FBS unit 3, the wedge-shaped portion 93 passes through the opening side portion of the load adjuster member 100 that defines the opening side region 107A of the guide groove 103. As described above, in the opening side portion of the load adjuster member 100 that defines the opening side region 107A, the thickness B2 of the flat thin-walled portion 106B is smaller than the thickness B1 of the upper end portion of the load adjuster member 100 (B2<B1) (see FIG. 11). Further, the thickness B2 of the flat thin-walled portion 106B is smaller than the value obtained by subtracting the maximum thickness A2 of the wedge-shaped portion 93 from the width of the accommodating recess 68 (B2<W−A2). Therefore, even while the load adjuster member 100 is being placed in the fully gripping position, the wedge-shaped portion 93 is not brought into pressing contact with the pressing contact portion 106 of the load adjuster member 100 and/or the right-side inner wall 66 of the accommodating recess 68, during sliding movement of the distal end portion 94 of the support stand 90 along the opening side region 107A of the guide groove 103. That is, the distal end portion 94 of the support stand 90 is smoothly slid along the opening side region 107A of the guide groove 103, without a large frictional force acting on the distal end portion 94.

In intermediate and final stages of the closing transition, the wedge-shaped portion 93 passes through the intermediate portion and closing side portion of the load adjuster member 100 that define the intermediate region 107B and closing side region 107C of the guide groove 103, while the wedge-shaped portion 93 is being held in pressing contact with the pressing contact portion 106 of the load adjuster member 100 and the right-side inner wall 66 of the accommodating recess 68. In the intermediate and closing side portions of the load adjuster member 100, the first and second uphill portions 106C, 106D are provided to gradually bulge in the thickness direction of the load adjuster ember 100 (see FIG. 12). The thickness B3 of the first uphill portion 106C and the thickness B4 of the second uphill portion 106D are gradually increased as viewed in a direction away from the front end portion of the load adjuster member 100 toward the rear end portion of the load adjuster member 100. Therefore, during sliding movement of the wedge-shaped portion 93 along the first and second uphill portions 106C, 106D up to the crest portion 106E, the frictional force generated due to the sliding contact is gradually increased whereby the FBS unit 3 is prevented from being rapidly pivoted in the closing direction.

In addition to the second downhill portion 106D and the crest portion 106E, the downhill portion 106F and the foot portion 106G are located in the closing side portion of the load adjuster member 100. In the downhill portion 106F interconnecting the crest portion 106E and the foot portion 106G, the thickness of the load adjuster member 100 is abruptly reduced as viewed in the direction away from the front end portion of the load adjuster member 100 toward the rear end portion of the load adjuster member 100, so that the bulge is eliminated in the foot portion 106G. Therefore, after the wedge-shaped portion 93 has passed the crest portion 106E, the frictional force generated due to the sliding contact is reduced owing to the downslope in the downhill portion 106F. In the foot portion 106G in which the bulge is eliminated, the thickness B6 of the downhill portion 106F is substantially equalized to the thickness B1 of the upper end portion of the load adjuster member 100 (in which neither the above-described elongated protrusion portion 110 nor pressing contact portion 106 is located). When the wedge-shaped portion 93 reaches the foot portion 106G, the FBS unit 3 is completely closed relative to the printer unit 2. Since there is no bulge in the foot portion 106G, it is possible to prevent reduction in elasticity of the high friction member 93A even where the FBS unit 3 is closed relative to the printer unit 2 for a large length of time.

As shown in FIGS. 15A and 16A, during placement of the load adjuster member 100 in the fully gripping position, the pressing contact portion 106 of the load adjuster member 100 is positioned to be opposed to the right-side inner wall 66 of the accommodating recess 68, with the distal end portion 94 of the support stand 90 being interposed between the pressing contact portion 106 and the right-side inner wall 66, namely, with the wedge-shaped portion 93 of the distal end portion 94 being wedged into between the pressing contact portion 106 of the load adjuster member 100 and the right-side inner wall 66 of the accommodating recess 68. When the FBS unit 3 is closed relative to the printer unit 2, the wedge-shaped portion 93 of the distal end portion 94 of the support stand 90 is forced to be wedged into between the pressing contact portion 106 of the load adjuster member 100 and the right-side inner wall 66 of the accommodating recess 68. As described above, the thickness of the wedge-shaped portion 93 is increased in the direction away from the distal end portion 94 of the support stand 90 toward the proximal end portion of the support stand 90. Therefore, as the wedge-shaped portion 93 is wedged into between the pressing contact portion 106 and the right-side inner wall 66, the pressing contact portion 106 and the right-side inner wall 66 of the accommodating recess 68 are forced away from each other, whereby a distance therebetween is increased. The wedge-shaped portion 93 is gripped between the pressing contact portion 106 and the right-side inner wall 66 of the accommodating recess 68 by a reaction force acting against the increase of the distance between the pressing contact portion 106 and the right-side inner wall 66. That is, during the closing transition of the FBS unit 3, since the wedge-shaped portion 93 is moved along the pressing contact portion 106 while being gripped between the pressing contact portion 106 and the right-side inner wall 66, a relatively large frictional force is generated. It is therefore possible to prevent the FBS unit 3 from being rapidly pivoted in the closing direction.

Further, as described above, the thickness of the pressing contact portion 106 of the load adjuster member 100 is reduced as seen in the direction away from the upper surface 111A of the load adjuster member 100 toward the lower surface 111B of the load adjuster member 100, at least in the first and second uphill portions 106C, 106D and the downhill portion 106F. In this arrangement, the wedge-shaped portion 93 and the pressing contact portion 106 can be brought into contact with each other at an area that is larger than in an arrangement in which the thickness of the pressing contact portion 106 is constant as seen in the vertical direction while the thickness of the wedge-shaped portion 93 is also constant. Therefore, this arrangement makes it possible to generate increased resistance acting against the sliding movement of the wedge-shaped portion 93 and accordingly to prevent the FBS unit 3 from being rapidly pivoted in the closing direction.

As described above, in the intermediate region 107B, the distance 114B between the upper and lower ends 103B and 103D of the guide groove 103 is smaller than the diameter D of the engaged pin 92 (114B<D) (see FIGS. 15A and 15B). Therefore, during sliding movement of the engaged pin 92 in the intermediate region 107B, the width of the guide groove 103 is increased by the engaged pin 92 that is slid along the guide groove 103. Further, when the FBS unit 3 is closed relative to the printer unit 2, the upper surface 111A of the load adjuster member 100 is forced against the bottom 68A of the accommodating recess 68 by a pressing force. Therefore, a load is applied against sliding movement of the engaged pin 92 along the intermediate region 107B of the guide groove 103. In other words, the engaged pin 92 is gripped between the upper and lower ends 103B, 103D of the guide groove 103 by a reaction force acting against the increase of the width of the guide groove 103. This arrangement makes it possible to prevent the FBS unit 3 from being rapidly pivoted in the closing direction in the intermediate region 107B.

In the closing side region 107C, the distance 114C between the upper and lower ends 103B and 103D is larger than the distance D of the engaged pin 92 (114C>D) (see FIGS. 16A and 16B). When the FBS unit 3 is closed relative to the printer unit 2, the engaged pin 92 passes the closing side region 107C along the upper end 103D, i.e., along a path Y (see FIG. 12) so as to be moved to the rear end 103C. Therefore, a portion of the pressing contact portion 106 that is located on the side of the lower end 103D is brought into contact with a proximal end portion of the high friction member 93A of the wedge-shaped portion 93 of the support stand 90. In other words, a portion of the pressing contact portion 106 that has a large thickness is brought into contact with the portion of the wedge-shaped portion 93 having a large thickness, whereby the pressing contact portion 106 and the wedge-shaped portion 63 are forced against each other by a large pressing force. Therefore, this arrangement makes it possible to generate increased resistance acting against the sliding movement of the wedge-shaped portion 93 and accordingly to prevent the FBS unit 3 from being rapidly pivoted in the closing direction.

There will be described operations of the support stand 90 and the load adjuster member 100 during the opening transition of the FBS unit 3 (during which the front portion of the FBS unit 3 is forced in a direction away from the front portion of the printer unit 2).

When the FBS unit 3 is placed from the closed position (as shown in FIG. 1) into the open position (as shown in FIG. 3), the load adjuster member 100 attached in the accommodating recess 68 of the casing 65 is pivoted upwardly together with the FBS unit 3.

Since the engaged pin 92 of the support stand 90 is engaged in the guide groove 103 of the load adjuster member 100, the engaged pin 92 is raised upwardly by the load adjuster member 100 when the FBS unit 3 is opened. As the engaged pin 92 is raised upwardly, the support stand 90 is pivoted to be placed in a vertical posture, and the engaged pin 92 is slid along the guide groove 103 in a direction away from the read end portion of the FBS unit 3 toward the front end portion of the FBS unit 3.

In this instance, the engaged pin 92 engaged in the guide groove 103 is forced against the lower end 103D of the guide groove 103, by a reaction opposite to a force which is applied from the load adjuster member 100 to the engaged pin 92 and which upwardly forces the engaged pin 92. That is, when the FBS unit 3 is opened relative to the printer unit 2, the engaged pin 92 is slid while being forced against the lower end 103D of the guide groove 103, whereby the second engaged protrusion 102 of the load adjuster member 100 is moved downwardly within the second engaging hole 59, so that the upper surface 111A of the load adjuster member 100 is separated from the bottom 68A of the accommodating recess 68 (see FIG. 13). That is, when the FBS unit 3 is opened relative to the printer unit 2, the load adjuster member 100 is placed in its non-fully gripping position whereby the pressing contact portion 106 as the part of the load adjuster member 100 protrudes downwardly from the accommodating recess 68. Further, when the FBS unit 3 is opened relative to the printer unit 2, the wedge-shaped portion 93 of the distal end portion 94 of the support stand 90 is forced to be removed from between the pressing contact portion 106 of the load adjuster member 100 and the right-side inner wall 66 of the accommodating recess 68.

In an initial stage of the opening transition from the closed position of the FBS unit 3 to the open position of the FBS unit 3, the engaged pin 92 is moved while being forced against the lower end 103D of the guide groove 103. The engaged pin 92 is moved along the lower end 103D in the closing side region 107C in which the distance 114C between the upper and lower ends 103B, 103D is larger than the distance D of the engaged pin 92. That is, in the closing side region 107, the engaged pin 92 is moved along a path X (see FIG. 12). Therefore, the portion of the pressing contact portion 106 that is located on the side of the lower end 103D is brought into contact with a distal end portion of the high friction member 93A of the wedge-shaped portion 93 of the support stand 90. In other words, the portion of the pressing contact portion 106 that is located on the side of the lower end 103D is brought into contact with the portion of the wedge-shaped portion 93 having a small thickness, whereby the pressing contact portion 106 and the wedge-shaped portion 63 are forced against each other by a pressing force that is smaller than in the final stage of the closing transition in which the engaged pin 92 is moved along the path Y. Since the resistance acting against the sliding movement of the wedge-shaped portion 93 is thus reduced, the FBS unit 3 can be quickly pivoted in the opening direction.

When the load adjuster member 100 is placed in its non-fully gripping position, the part (including the pressing contact portion 106) of the load adjuster member 100 protrudes out from the accommodating recess 68, as shown in FIGS. 13, 15B and 16B. Further, since the engaged pin 92 is engaged in the guide groove 103 of the load adjuster member 100, the wedge-shaped portion 93 also protrudes out from the accommodating recess 68. Described more specifically, a portion of the high friction member 93A having the maximum thickness A2 is removed from between the pressing contact portion 106 and the right-side inner wall 66 of the accommodating recess 68. Therefore, when the engaged pin 92 of the distal end portion 94 of the support stand 90 is slid along the guide groove 103 during the placement of the load adjuster member 100 in the non-fully gripping position, the frictional force generated due to the sliding contact is smaller than during placement of the load adjuster member 100 in the fully gripping position. In this instance, since only a part of the wedge-shaped portion 93 having the minimum thickness A1 is located in the spaced defined between the mutually opposed surfaces of the accommodating recess 68, the wedge-shaped portion 93 is not fully gripped by the pressing contact portion 106C of the load adjuster member 100 and the right-side inner wall 66 of the accommodating recess 68, an excessively large frictional force is not generated by the sliding contact of the wedge-shaped portion 93 with the pressing contact portion 106 and the right-side inner wall 66, whereby the FBS unit 3 is lightly opened.

As described above, in the intermediate region 107B of the guide groove 103, the distance 114B between the upper and lower ends 103B and 103D of the guide groove 103 is smaller than the diameter D of the engaged pin 92 (114B<D) (see FIGS. 15A and 15B). Therefore, during sliding movement of the engaged pin 92 in the intermediate region 107B, the width of the guide groove 103 is increased by the engaged pin 92 that is slid along the guide groove 103. That is, the upper surface 111A of the load adjuster member 100 is elastically deformed to bulge in the width direction of the load adjuster member 100 (i.e., in a direction indicated by arrow F of FIG. 12). As described above, the upper surface 111A of the load adjuster member 100 is separated from the bottom 68A of the accommodating recess 68 during placement of the load adjuster member 100 in the non-fully gripping position. That is, since the upper surface 111A of the load adjuster member 100 is separated from the bottom 68A during sliding movement of the engaged pin 92 along the guide groove 103 in a direction away from the rear end portion of the FBS unit 3 toward the front end portion of the FBS unit 3, the upper surface 111A can be easily deformed to bulge in the upward direction indicated by arrow F of FIG. 12. Therefore, during the opening transition of the FBS unit 3, the engaged pin 92 can be smoothly slid along the intermediate portion 107B of the guide groove 103.

When the FBS unit 3 is completely opened, the engaged pin 92 of the support stand 90 is introduced into the engaged end groove 104 from the guide groove 103. By the introduction of the engaged pin 92 into the engaged end groove 104, the sliding movement of the engaged pin 92 along the guide groove 103 in the longitudinal direction of the load adjuster member 100 is limited whereby the support stand 90 is held in a vertical posture for maintaining the open portion of the FBS unit 3 relative to the printer unit 2, as shown in FIG. 3. Thus, the support stand 90 serves as a diagonal brace to maintain the open position of the FBS unit 3 relative to the printer unit 2.

In the present embodiment, the load adjuster member 100 is placed in its fully gripping position when the FBS unit 3 is being closed relative to the printer unit 2, and is placed in its non-fully gripping position when the FBS unit 3 is being opened relative to the printer unit 2. Described specifically, during placement of the load adjuster member 100 in the fully gripping position, the pressing contact portion 106 of the load adjuster member 100 is positioned to be opposed to the right-side inner wall 66 of the accommodating recess 68, with the distal end portion 94 of the support stand 90 being interposed between the pressing contact portion 106 and the right-side inner wall 66, namely, with the wedge-shaped portion 93 of the distal end portion 94 being wedged into between the pressing contact portion 106 of the load adjuster member 100 and the right-side inner wall 66 of the accommodating recess 68. Therefore, when the engaged pin 92 of the distal end portion 94 of the support stand 90 is slid along the guide groove 103 during the placement of the load adjuster member 100 in the fully gripping position, a frictional force is generated due to the sliding contact of the wedge-shaped portion 93 with the pressing contact portion 106 and the right-side inner wall 66 (see FIGS. 15A and 16A). In this instance, an amount of the generated frictional force is changed depending on the thickness of the pressing contact portion 106 that is not constant as described above. On the other hand, while the load adjuster member 100 is placed in its non-fully gripping position, the part (including the pressing contact portion 106) of the load adjuster member 100 protrudes out from the accommodating recess 68 (see FIG. 13). That is, during placement of the load adjuster member 100 in the non-fully gripping position, the wedge-shaped portion 93 of the distal end portion 94 is wedged into between the pressing contact portion 106 of the load adjuster member 100 and the right-side inner wall 66 of the accommodating recess 68, by an extent smaller than during placement of the load adjuster member 100 in the fully gripping position (see FIGS. 15B and 16B). Therefore, when the engaged pin 92 of the distal end portion 94 of the support stand 90 is slid along the guide groove 103 during the placement of the load adjuster member 100 in the non-fully gripping position, the frictional force generated due to the sliding contact is smaller than during placement of the load adjuster member 100 in the fully gripping position. It is therefore possible to establish an opening and closing assembly in which the FBS unit 3 can be closed and opened relative to the printer unit 2, slowly and quickly, respectively.

Further, the thickness B2 of the flat thin-walled portion 106B (located in the opening side portion of the load adjuster member 100) is smaller than the value obtained by subtracting the maximum thickness A2 of the wedge-shaped portion 93 from the width of the accommodating recess 68 (B2<W−A2). Therefore, even while the load adjuster member 100 is being placed in the fully gripping position, the wedge-shaped portion 93 is not brought into pressing contact with the pressing contact portion 106 of the load adjuster member 100 and/or the right-side inner wall 66 of the accommodating recess 68, during sliding movement of the distal end portion 94 of the support stand 90 along the opening side region 107A of the guide groove 103. That is, the distal end portion 94 of the support stand 90 is smoothly slid along the opening side region 107A of the guide groove 103, without a large frictional force acting on the distal end portion 94. Thus, the FBS unit 3 can be lightly pivoted in the initial stage of the closing transition.

When the wedge-shaped portion 93 passes the intermediate portion and closing side portion of the load adjuster member 100 while being slid along the guide groove 103, the wedge-shaped portion 93 is pressed by the pressing contact portion 106 of the load adjuster member 100 and the right-side inner wall 66 of the accommodating recess 68. Particularly, while the wedge-shaped portion 93 is passing the first and second uphill portions 106C, 106D, the resistance acting against the sliding movement of the wedge-shaped portion 93 is gradually increased. Thus, in the final stage of the closing transition, the FBS unit 3 is slowly pivoted and can be prevented from being rapidly pivoted in the closing direction. It is therefore possible to establish an opening and closing assembly in which the FBS unit 3 can be closed and opened relative to the printer unit 2, slowly and quickly, respectively.

Further, in the downhill portion 106F interconnecting the crest portion 106E and the foot portion 106G, the thickness of the load adjuster member 100 is abruptly reduced as viewed in the direction away from the front end portion of the load adjuster member 100 toward the rear end portion of the load adjuster member 100, so that the bulge is eliminated in the foot portion 106G, namely, so that the thickness of the foot portion 106G is substantially equalized to the thickness B1 of the upper end portion of the load adjuster member 100 (in which neither the above-described elongated protrusion portion 110 nor pressing contact portion 106 is located). Since there is no bulge in the foot portion 106G, it is possible to prevent reduction in elasticity of the high friction member 93A even where the FBS unit 3 is closed relative to the printer unit 2 for a large length of time.

In the intermediate region 107B of the guide groove 103, the distance 114B between the upper and lower ends 103B and 103D of the guide groove 103 is smaller than the diameter D of the engaged pin 92 (114B<D) (see FIGS. 15A and 15B). Therefore, during sliding movement of the engaged pin 92 in the intermediate region 107B, the width of the guide groove 103 is increased by the engaged pin 92 that is slid along the guide groove 103. That is, when the FBS unit 3 is closed relative to the printer unit 2, the upper surface 111A of the load adjuster member 100 is forced against the bottom 68A of the accommodating recess 68 by a pressing force. Therefore, a load is applied against sliding movement of the engaged pin 92 along the intermediate region 107B of the guide groove 103, whereby the FBS unit 3 is prevented from being rapidly pivoted in the closing direction while the engaged pin 92 is in the intermediate region 107B of the guide groove 103. On the other hand, when the FBS unit 3 is opened relative to the printer unit 2, namely, when the load adjuster member 100 is placed in its non-fully gripping position, the upper surface 111A of the load adjuster member 100 is spaced apart from the bottom 68A of the accommodating recess 68. Since the upper surface 111A of the load adjuster member 100 is spaced apart from the bottom 68A of the accommodating recess 68, the upper surface 111A can be easily deformed to bulge in the upward direction. Therefore, during the opening transition of the FBS unit 3, the engaged pin 92 can be smoothly slid along the intermediate portion 107B of the guide groove 103.

While the preferred embodiment of the invention has been described in detail by reference to the accompanying drawings, it is to be understood that the invention is not limited to the details of the illustrated embodiment, but may be embodied with various other changes, modifications and improvements, which may occur to those skilled in the art.

For example, one of the upper surface 111A of the load adjuster member 100 and the bottom 68A of the accommodating recess 68 may protrude toward the other of the upper surface 111A and the bottom 68A. In this modified arrangement, when the load adjuster member 100 is placed in its fully gripping position, the upper surface 111A of the load adjuster member 100 is brought into contact with the bottom 68A of the accommodating recess 68, whereby the width of the guide groove 103 is made smaller than when the load adjuster member 100 is placed in its non-fully gripping position. It is noted that, in this modified arrangement, the guide groove 103 does not have to include a portion in which the distance between the upper end lower ends 103B, 103D of the guide groove 103 is smaller than the diameter D of the engaged pin 92.

Further, in the above-described preferred embodiment, the opening and closing assembly is constituted by the main body 10 of the multifunction device 1, and the first and second casing bodies are provided by the printer unit 2 and the FBS unit 3 which is superposed on the printer unit 2 and which can be opened and closed relative to the printer unit 2. However, the opening and closing assembly may be otherwise constituted. For example, the first casing body and the second casing body may be provided by a unit that is perpendicularly fixed to a wall surface and another unit that is pivotable relative to the unit, respectively.

Further, the main body 10 of the multifunction device 1 may be modified such that the pivot-boss receiving portion 130 is provided in the FBS unit 3 while the load adjuster member 100 is provided in the printer unit 2 and such that the pivot boss 98 of the support stand 90 is pivotably connected to the FBS unit 3 while the engaged pin 92 of the support stand 90 is slidably connected to the printer unit 2 through the guide groove 103 of the load adjuster member 100 that is fixed to the printer unit 2.

Referring next to FIGS. 17A, 17B, 18A, 18B and 18C, there will be described another embodiment of the present invention.

Figure 17B:
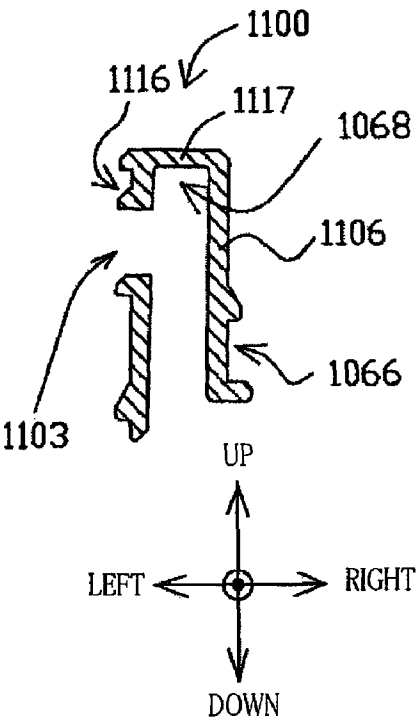
FIG. 17B is a cross sectional view as seen in a direction indicated by arrows XVIIB-XVIIB of FIG. 17A.
Figure 17A:
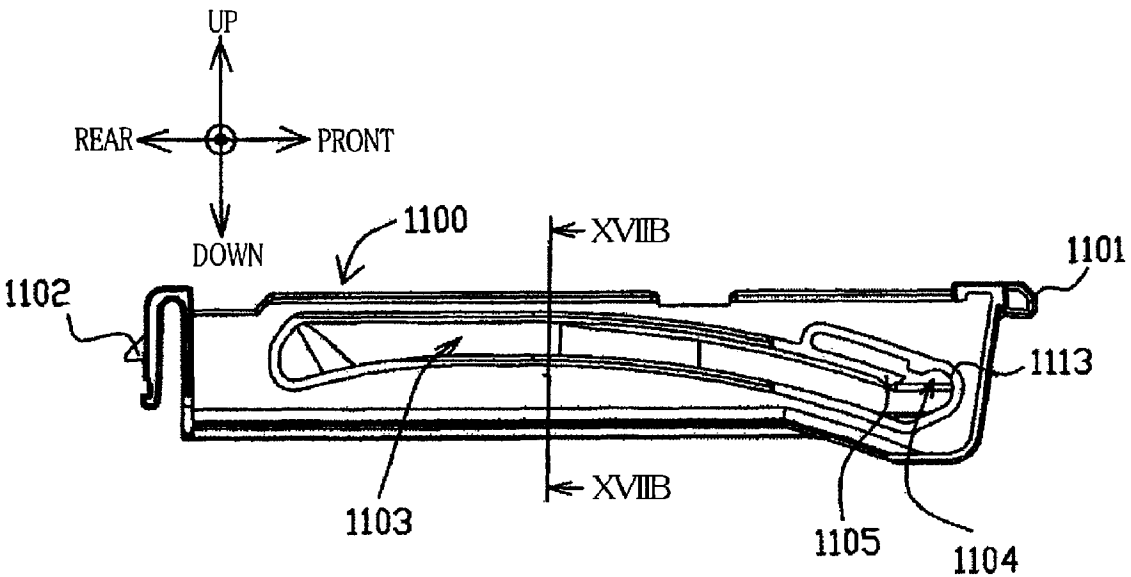
FIG. 17A is a view of a load adjuster member in another embodiment of the invention.
Figures 18A, 18B, 18C:
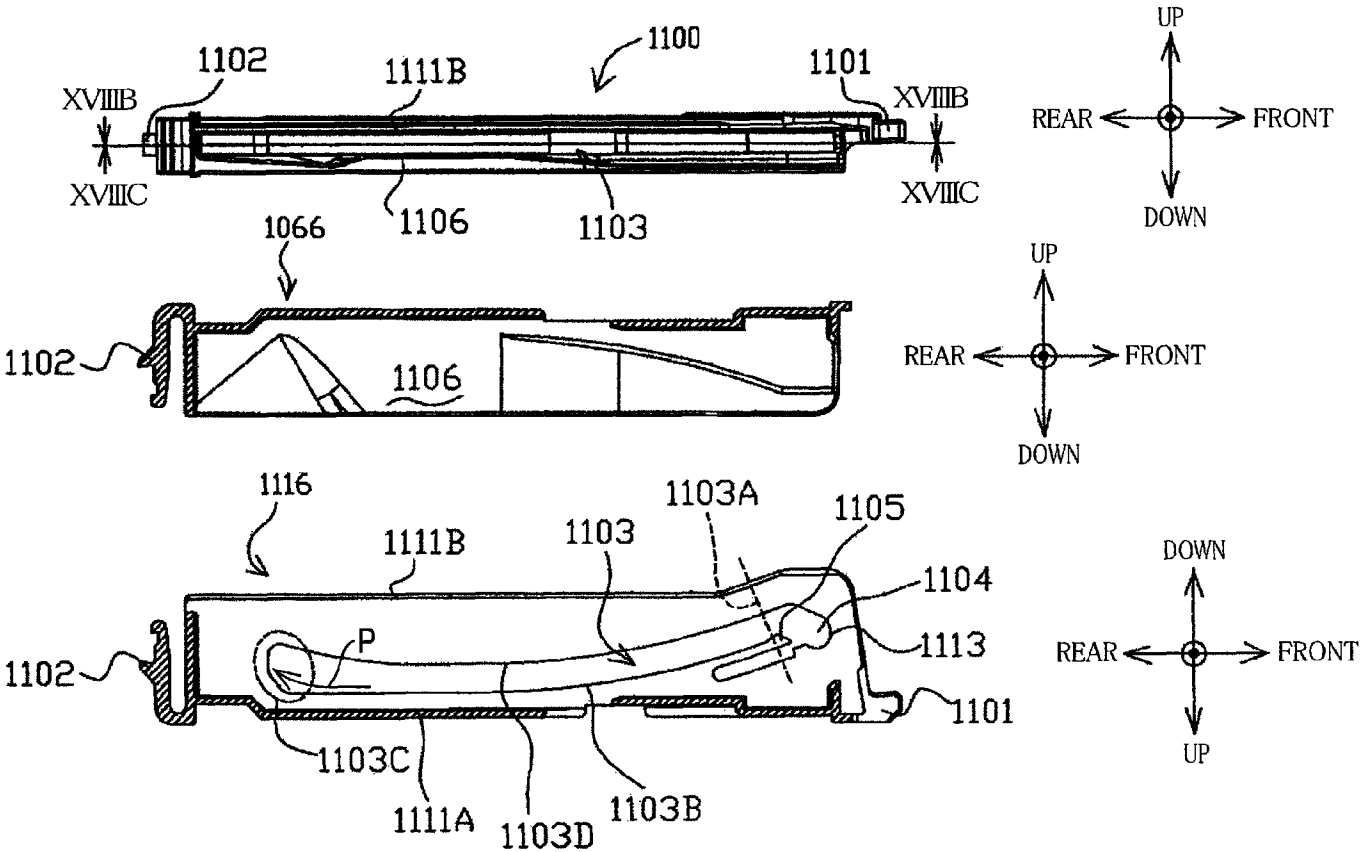
FIG. 18A is an upper view of the load adjuster member of FIG. 17A.
FIG. 18B is a cross sectional view as seen in a direction indicated by arrows XVIIIB-XVIIIB of FIG. 18A.
FIG. 18C is a cross sectional view as seen in a direction indicated by arrows XVIIIC-XVIIIC of FIG. 18A.

In this another embodiment, a load adjuster member 1100 as the grooved member is different in construction from the load adjuster member 100 of the above-described embodiment. The load adjuster member 1100 includes a guide wall 1116 as the first wall portion, an opposed wall 1066 as the second wall portion, and an interconnecting wall 11117 interconnecting the guide wall 1116 and the opposed wall 1066, so that the load adjuster member 1100 has a generally U-shaped cross sectional shape as a whole, as shown in FIG. 17B. The guide wall 1116 has a guide groove 1103, while the opposed wall 1066 has a pressing contact portion 1106. Like the above-described load adjuster member 100, the load adjuster member 1100 is attached in the accommodating recess 68 through first and second engaged portions 1101, 1102 that are provided in respective front and rear end portions of the load adjuster member 1100. The load adjuster member 1100 is pivotable about the first engaged protrusion 1101, and the second engaged protrusion 1102 is displaceable within the second engaging hole 59 in the depth direction of the accommodating recess 68. By the displacement of the load adjuster member 1100 relative to the accommodating recess 68, the load adjuster member 1100 can be selectively placed in its fully gripping position and its non-fully gripping position. When being placed in its fully gripping position, the load adjuster member 1100 is accommodated substantially in its entirety within the accommodating recess 68. When being placed in its non-fully gripping position, the load adjuster member 1100 partially protrudes out from the accommodating recess 68.

In this embodiment, the pressing contact portion 1106 is provided also in a portion of the opposed wall 1066 that is opposed to the guide groove 1103, as shown in FIG. 17B. Therefore, even where the engaged pin 92 is moved along a path P indicated by arrow in FIG. 18C when the FBS unit 3 is closed relative to the printer unit 2, the high friction member 93A of the wedge-shaped portion 93 is brought into pressing contact with the pressing contact portion 1106, thereby generating a large resistance acting against the sliding movement of the wedge-shaped portion 93. It is therefore possible to prevent the FBS unit 3 from being rapidly pivoted in the closing direction, even where the FBS unit 3 has a large weight, for example, in a case of provision of the automatic document feeder in the FBS unit 3.

Further, in this embodiment in which the pressing contact portion 1106 is provided to be opposed to the guide groove 1103, a vertical size of the load adjuster member 1100 (as measured in the vertical direction of the main body 10) can be made smaller than in the above-described embodiment in which the pressing contact portion 106 is provided to be adjacent to the guide groove 103. That is, by incorporating the load adjuster member 1100 into the main body 10, the multifunction device 1 as a whole can be made small in its size, particularly, in its vertical size.

What is claimed is:

1. An opening and closing assembly comprising:

(a) a first casing body having a connected portion and a distant portion that is distant from said connected portion;

(b) a second casing body having a connected portion and a distant portion that is distant from said connected portion of said second casing body, said second casing body being connected at said connected portion thereof to said connected portion of said first casing body, and being pivotable about said connected portions of said respective first and second casing bodies relative to said first casing body so as to be selectively placed in open and closed positions relative to said first casing body; and (c) a support stand configured to support said second casing body so as to maintain the open position of said second casing body when said second casing body is to be held in the open position, said support stand including (c-1) a proximal end portion that is pivotably connected to said distant portion of one of said first and second casing bodies and (c-2) a distal end portion that is slidably connected to the other of said first and second casing bodies, wherein said other of said first and second casing bodies includes (i) a guide portion configured to guide said distal end portion of said support stand, for permitting said distal end portion of said support stand to be sidable between said connected portion and said distant portion of said other of said first and second casing bodies, and (ii) first and second wall portions opposed to each other and cooperating with each other for gripping said distal end portion of said support stand that is interposed between said first and second wall portions, wherein said distal end portion of said support stand includes a gripped portion at which said distal end portion can be gripped between said first and second wall portions of said other of said first and second casing bodies, and at which said distal end portion can be brought into slidable contact with said first and second wall portions of said other of said first and second casing bodies, and wherein a thickness of said gripped portion, as measured in an opposed direction in which said first and second wall portions are opposed to each other, is increased in a direction away from said distal end portion of said support stand toward said proximal end portion of said support stand.

2. The opening and closing assembly according to claim 1, wherein said gripped portion of said distal end portion of said support stand is wedged into between said first and second wall portions by a larger extent during a closing transition from the open position of said second casing body to the closed position of said second casing body during which said distant portion of said second casing body is forced in a direction toward said distant portion of said first casing body, than during an opening transition from the closed position to the open position during which said distant portion of said second casing body is forced in a direction away from said distant portion of said first casing body.

3. The opening and closing assembly according to claim 1, wherein said support stand is provided by at least two portions including a high friction portion which has a higher coefficient of friction than the other of said at least two portions, and wherein said gripped portion of said distal end portion of said support stand has a contact surface which can be brought into slidable contact with said first and second wall portions of said other of said first and second casing bodies and which is at least partially provided by said high friction portion.

4. The opening and closing assembly according to claim 1, wherein said other of said first and second casing bodies is brought into contact at one of opposite side surfaces thereof with said one of said first and second casing bodies when said second casing body is placed in the closed position, and wherein said other of said first and second casing bodies includes a portion in which a distance between said first and second wall portions of said other of said first and second casing bodies, as measured in said opposed direction, is reduced in a direction away from said one of said opposite side surfaces toward the other of said opposite side surfaces.

5. The opening and closing assembly according to claim 1, wherein said other of said first and second casing bodies includes a grooved member which provides at least one of said first and second wall portions and which has a guide groove as said guide portion, wherein said guide groove is provided in each of at least one of said at least one of said first and second wall portions, and extends in a sliding direction in which said distal end portion of said support stand is slidable between said connected portion and said distant portion of said other of said first and second casing bodies, and wherein said distal end portion of said support stand includes an engaged portion that is slidably engaged in said guide groove.

6. The opening and closing assembly according to claim 5, wherein said other of said first and second casing bodies includes a portion in which a distance between said first and second wall portions of said other of said first and second casing bodies, as measured in said opposed direction, is reduced in a direction away from said distant portion of said other of said first and second casing bodies toward said connected portion of said other of said first and second casing bodies.

7. The opening and closing assembly according to claim 1, wherein one of said first and second wall portions and said distal end portion of said support stand are displaceable relative to the other of said first and second wall portions, so as to be selectively placed in a fully gripping position thereof and a non-fully gripping position thereof, such that a contact area of said gripped portion of said distal end portion, which is held in contact with said other of said first and second wall portions, is smaller when said one of said first and second wall portions and said distal end portion are placed in the non-fully gripping position than when said one of said first and second wall portions and said distal end portion are placed in the fully gripping position, and wherein said one of said first and second wall portions and said distal end portion are placed in the fully gripping position during a closing transition from the open position of said second casing body to the closed position of said second casing body, and are placed in the non-fully gripping position during an opening transition from the closed position to the open position.

8. The opening and closing assembly according to claim 7, wherein said gripped portion of said distal end portion of said support stand is pressed against said first and second wall portions by a larger extent during said closing transition than during said opening transition.

9. The opening and closing assembly according to claim 5, wherein said other of said first and second casing bodies has an accommodating recess which is elongated in said sliding direction and which accommodates said grooved member and said distal end portion of said support stand, wherein said grooved member provides one of said first and second wall portions, wherein said grooved member and said distal end portion of said support stand are interposed between mutually opposed surfaces of said accommodating recess one of which is provided by the other of said first and second wall portions, wherein said grooved member and said distal end portion of said support stand are displaceable relative to said accommodating recess, so as to be selectively placed in a fully gripping position thereof and a non-fully gripping position thereof, wherein said grooved member is forced by said engaged portion of said distal end portion of said support stand in a direction away from an opening of said accommodating recess toward a bottom of said accommodating recess during a closing transition from the open position of said second casing body to the closed position of said second casing body, whereby said grooved member and said distal end portion are placed in said fully gripping position during said closing transition, and wherein said grooved member is forced by said engaged portion of said distal end portion of said support stand in a direction away from said bottom of said accommodating recess toward said opening of said accommodating recess during an opening transition from the closed position to the open position, whereby said grooved member and said distal end portion are placed in said non-fully gripping position during said opening transition.

10. The opening and closing assembly according to claim 5, wherein said other of said first and second casing bodies has an accommodating recess which is elongated in said sliding direction and which accommodates said grooved member and said distal end portion of said support stand, wherein said grooved member provides both of said first and second wall portions, wherein said grooved member and said distal end portion of said support stand are interposed between mutually opposed surfaces of said accommodating recess, wherein said grooved member and said distal end portion of said support stand are displaceable relative to said accommodating recess, so as to be selectively placed in a fully gripping position thereof and a non-fully gripping position thereof, wherein said grooved member is forced by said engaged portion of said distal end portion of said support stand in a direction away from an opening of said accommodating recess toward a bottom of said accommodating recess during a closing transition from the open position of said second casing body to the closed position of said second casing body, whereby said grooved member and said distal end portion are placed in said fully gripping position during said closing transition, and wherein said grooved member is forced by said engaged portion of said distal end portion of said support stand in a direction away from said bottom of said accommodating recess toward said opening of said accommodating recess during an opening transition from the closed position to the open position, whereby said grooved member and said distal end portion are placed in said non-fully gripping position during said opening transition.

11. A multifunction device comprising:

the opening and closing assembly defined in claim 1, wherein said first casing body of said opening and closing assembly provides an image recording unit configured to record an image on a recording medium, while said second casing body of said opening and closing assembly provides an image reading unit configured to read an image carried on an original.

* * * * *